US005616349A

United States Patent [19]

Sasaki

[11] Patent Number: 5,616,349

[45] Date of Patent: Apr. 1, 1997

[54] MOVABLE SLAB FORM UNIT

[76] Inventor: Mitsuo Sasaki, 3-11-12 Yamato-higashi, Yamato-shi, Kanagawa-ken, Japan

[21] Appl. No.: 371,869

[22] Filed: Jan. 12, 1995

[30] Foreign Application Priority Data

Jan. 20, 1994 [JP] Japan ..... 6-018783
Aug. 17, 1994 [JP] Japan ..... 6-214313

[51] Int. Cl.[6] ..... E04G 11/38; E04G 11/48

[52] U.S. Cl. ..... 425/62; 249/18; 249/156; 249/171; 249/192; 425/186

[58] Field of Search ..... 425/62, 186, 470, 425/63; 249/18, 28, 192, 209, 156, 159, 170, 171

[56] References Cited

U.S. PATENT DOCUMENTS 537,781 4/1895 Toye ..... 425/62
1,596,868 8/1926 Brynoldt ..... 425/62
2,671,697 9/1954 North ..... 425/62
3,320,646 5/1967 Wilkins ..... 425/62
3,744,945 7/1973 Metrailer ..... 249/18
3,827,840 8/1974 Kistler ..... 425/62
3,847,521 11/1974 Stickler, Jr. ..... 425/62
3,940,105 2/1976 Metrailer ..... 249/209
4,078,759 3/1978 Lanier ..... 249/18

*Primary Examiner*—Jay H. Woo
*Assistant Examiner*—Joseph Leyson
*Attorney, Agent, or Firm*—Beveridge, DeGrandi, Weilacher & Young, L.L.P.

[57] ABSTRACT

A movable slab form unit is provided and has a movable base plate, a slab form, an elevation motion device that connects the slab form to the base plate while maintaining the freedom of being raised and lowered, and a stabilizer device for stabilizing the elevation motion device into a predetermined state. The elevation motion device includes a first link which is pivotably coupled at its lower ends to the base plate, a second link which is coupled at its lower ends to the base plate so as to move along the base plate and a coupling pin for pivotably coupling the first link and second link together. The stabilizer means includes a support rod of which the length can be adjusted, and is pivotably coupled at its one end to the second link and is detachably engaged at its other end with an engaging portion provided on the base plate.

3 Claims, 20 Drawing Sheets

MOVABLE SLAB FORM UNIT

FIELD OF THE INVENTION

The present invention relates to a movable slab form unit and, more specifically, to a movable slab form unit that is adapted to forming concrete slabs in a concrete construction.

DESCRIPTION OF THE PRIOR ART

In general, slabs in a concrete construction are formed by assembling slab forms at predetermined positions on a concrete floor and pouring concrete into the slab forms. A typical example of the slab form is assembled by arranging a plurality of pipe supports at predetermined positions via steady-rest pipes, providing square pipes which are sleepers at the upper ends thereof, arranging round pipes which are common joists on the square pipes at right angles thereto, and arranging a veneer on the round pipes.

The conventional slab form briefly described above is made up of many numbers and many kinds of members such as square pipes, round pipes, fastening fittings, pipe supports, veneer, etc. that must be assembled from the null state for every time of starting the construction. After the construction has been finished, furthermore, the assembled slab form must be disassembled into individual members. That is, the conventional slab form is assembled requiring quite a many number of assembling steps involving cumbersome assembling operation which is inefficient, and further requires steps for disassembling. Accordingly, the slab form is assembled or disassembled requiring very extended periods of working time and a lot of manpower, causing the completion of construction to be prolonged. A further increased amount of manpower is required if it is attempted to shorten the period of construction. In order to maintain precision needed for the slab form, furthermore, a high degree of skill is required for the assembling operation. Besides, use is made of a veneer which is subject to be worn out. The veneer, however, absorbs water of the concrete and can be repetitively used only a small number of times (three to five times), which is the waste of resources. When the veneer is used, furthermore, the poured concrete does not necessarily acquire a smooth surface since the veneer has a coarse surface. Moreover, the veneer is parted with difficultly from the concrete, and a parting agent is used for improving parting property, causing the operation efficiency to become poor and requiring increased steps of operation. With the conventional slab form, as will be obvious from the above description, the operation efficiency as a whole is very poor, so that the construction period becomes long, and, as a high degree of skill is required, it is difficult to maintain precision. Besides, the cost of construction is driven up by increase in the personnel expenses and the cost of wear and tear of parts.

SUMMARY OF THE INVENTION

The principal object of the present invention is to provide a movable slab form unit which makes it possible to achieve a very high operation efficiency and a required degree of precision, and further makes it possible to save in the cost of construction. Other objects and features of the present invention will become apparent from the following description.

According to a first aspect of the present invention, there is provided a movable slab form unit, characterized in that it comprises a base plate which is movable along a surface on which it is placed, a slab form means, an elevation motion means for connecting said slab form means to said base plate with the freedom of being raised and lowered, and a stabilizer means for stabilizing said elevation motion means into a predetermined state;

said elevation motion means includes a first link which is pivotably coupled at its lower ends to the base plate, a second link which is coupled at its lower ends to the base plate so as to move along the base plate, and a coupling pin which pivotably couples together an intermediate portion of the first link and an intermediate portion of the second link; and said stabilizer means includes a support rod means of which the length can be adjusted, one end of the support rod means being pivotally coupled to said second link, the other end of the support rod means capable of being detachably engaged with an engaging portion provided on the base plate, and that the other end of the support rod means is brought into detachable engagement with the engaging portion of the base plate so that the lower end of the second link of the elevation motion means is prevented from moving along the base plate in a direction in which the slab form means descends.

According to another aspect of the present invention, there is provided a movable slab form unit, characterized in that it comprises a base plate which is movable along a surface on which it is placed, a slab form means, an elevation motion means for connecting said slab form means to said base plate with the freedom of being raised and lowered, and a stabilizer means for stabilizing said elevation motion means into a predetermined state;

said elevation motion means includes a first link which is pivotally coupled at its upper ends to the slab form means, a second link which is coupled at its upper ends to the slab form means so as to move along the slab form means, and a coupling pin which pivotably couples together an intermediate portion of the first link and an intermediate portion of the second link; and said stabilizer means includes a support rod means of which the length can be adjusted, one end of the support rod means being pivotably coupled to the second link, the other end of the support rod means capable being detachably engaged with an engaging portion provided on the slab form means, and that the other end of the support rod means is brought into engagement with the engaging portion of the slab form means so that the upper end of the second link of the elevation motion means is prevented from moving along the slab form means in a direction in which the slab form means descends.

According to a further aspect of the present invention, there is provided a movable slab form unit, characterized in that it comprises a base plate which is movable along a surface on which it is placed, a slab form means, and an elevation motion means for connecting said slab form means to said base plate with the freedom of being raised and lowered;

said slab form means includes a main frame body which has a substantially rectangular shape and a substantially flat upper surface, and auxiliary frame bodies which are disposed by the side portions of the main frame body neighboring thereto and have a substantially rectangular shape and substantially flat upper surfaces;

side portions of the auxiliary frame bodies are pivotally coupled to the side portions of the main frame body via hinge means, so that the auxiliary frame bodies are selectively brought to a use state in which the upper surfaces thereof are positioned to be substantially flush with the upper surface of the main frame body and to a non-use state in which the upper surfaces thereof hang down from the side portions of the main frame body; and ends of support rod means of which the length can be adjusted are pivotably supported at both ends on the other side portions of the auxiliary frame bodies, downwardly extending support members are provided at both ends on one side portion of the main frame body, correspondingly to the support rod means, engaging portions are provided at lower end portions of the support members so as to come into detachable engagement with the other ends of the rod support means, and the state where the auxiliary frame bodies are used is defined by the engagement of other ends of the support rod means with the engaging portions of the corresponding support members.

The base plate is movable along a surface on which it is placed and, hence, the unit can be easily moved and positioned at a predetermined position. The slab form means can be raised and lowered by the elevation motion means and can, hence, be easily positioned at a predetermined height. The unit is equipped with the stabilizer means for stabilizing the elevator means into a predetermined state.

According to one aspect of the present invention, the elevation motion means includes a first link which is pivotably coupled at its lower ends to the base plate, a second link which is coupled at its lower ends to the base plate so as to move along the base plate, and a coupling pin which pivotably couples together an intermediate portion of the first link and an intermediate portion of the second link. The stabilizer means includes a support rod means of which the length can be adjusted. One end of the support rod means is pivotably coupled to the second link, the other end of the support rod means can be detachably engaged with an engaging portion provided on the base plate; and the other end of the support rod means is brought into engagement with the engaging portion of the base plate in order that the lower end of the second link of the elevation motion means is prevented from moving along the base plate in a direction in which the slab form means descends. Presence of the rod means greatly helps prevent the displacement of the elevation motion means and maintain a predetermined attitude of the elevation motion means at the time of ascending operation despite a change in the load exerted on the elevation motion means via the slab form means when concrete is poured. That is, the second link which is coupled at its lower ends to the base plate to move along the base plate and loses stability when it supports the load, is reliably prevented from moving owing to the support rod means. Accordingly, the elevation motion means is reliably prevented, i.e., the slab form means is reliably prevented from being deviated by a change in the load, and a required high degree of precision is easily guaranteed for the molding frame.

According to another aspect of the present invention, the elevation motion means includes a first link which is pivotably coupled at its upper ends to the slab form means, a second link which is coupled at its upper ends to the slab form means so as to move along the slab form means, and a coupling pin which pivotably couples together an intermediate portion of the first link and an intermediate portion of the second link. The stabilizer means includes a support rod means of which the length can be adjusted. One end of the support rod means is pivotably coupled to the second link, the other end of the support rod means is capable of being detachably engaged with an engaging portion provided on the slab form means, and the other end of the support rod means is brought into engagement with the engaging portion of the slab form means in order that the upper end of the second link of the elevation motion means is prevented from moving along the slab form means in a direction in which the slab form means descends. Presence of the rod means greatly helps prevent the displacement of the elevation motion means and maintain a predetermined attitude of the elevation motion means at the time of ascending operation despite a change in the load exerted on the elevation motion means via the slab form means when concrete is poured. That is, the second link which is coupled at its upper end to the slab form means to move along the slab form means and loses stability when it supports the load, is reliably prevented from moving owing to the support rod means. Accordingly, the elevation motion means is reliably prevented, i.e., the slab form means is reliably prevented from being deviated by a change in the load, and a required high degree of precision is easily guaranteed for the molding frame.

According to a further aspect of the present invention, the slab form means includes a main frame body which has a substantially rectangular shape and a substantially flat upper surface, and auxiliary frame bodies which are disposed by the side portions of the main frame body neighboring thereto and have a substantially rectangular shape and substantially flat upper surfaces. Side portion of the auxiliary frame bodies are pivotally coupled to the side portions of the main frame body via hinge means, so that the auxiliary frame bodies are selectively brought to a use state in which the upper surfaces thereof are positioned to be substantially flush with the upper surface of the main frame body and to a non-use state in which the upper surfaces thereof hang down from the side portions of the main frame body. Ends of support rod means of which the length can be adjusted are pivotably supported at both ends on the other side portions of the auxiliary frame bodies. Downwardly extending support members are provided at both ends on one side portion of the main frame body, correspondingly to the support rod means. Engaging portions are provided at lower end portions of the support members so as to come into detachable engagement with the other end of the rod support means. The state where the auxiliary frame bodies are used is defined by the engagement of other ends of the support rod means with the engaging portions of the corresponding support members. Therefore, the auxiliary frame members can be easily held in the use state by the support rod means, and the load acting upon the auxiliary frame bodies is reliably supported by the support rod means. Moreover, by adjusting the lengths of the support rod means of which the lengths are adjustable, the upper surfaces of the auxiliary frames can be very easily positioned to be in flush with the upper surface of the main frame body. This helps markedly improve the operation efficiency.

BRIEF DESCRIPTION OF THE DRAWINGS

FIG. 1 is viewed from the right, and illustrates a portion of the movable slab form unit in a cut-away manner;

FIG. 17 is viewed from the right side;

FIG. 21 is viewed from the left, and shows part of the elevation motion means in a simplified manner;

DETAILED DESCRIPTION OF THE PREFERRED EMBODIMENTS

Figure 1:
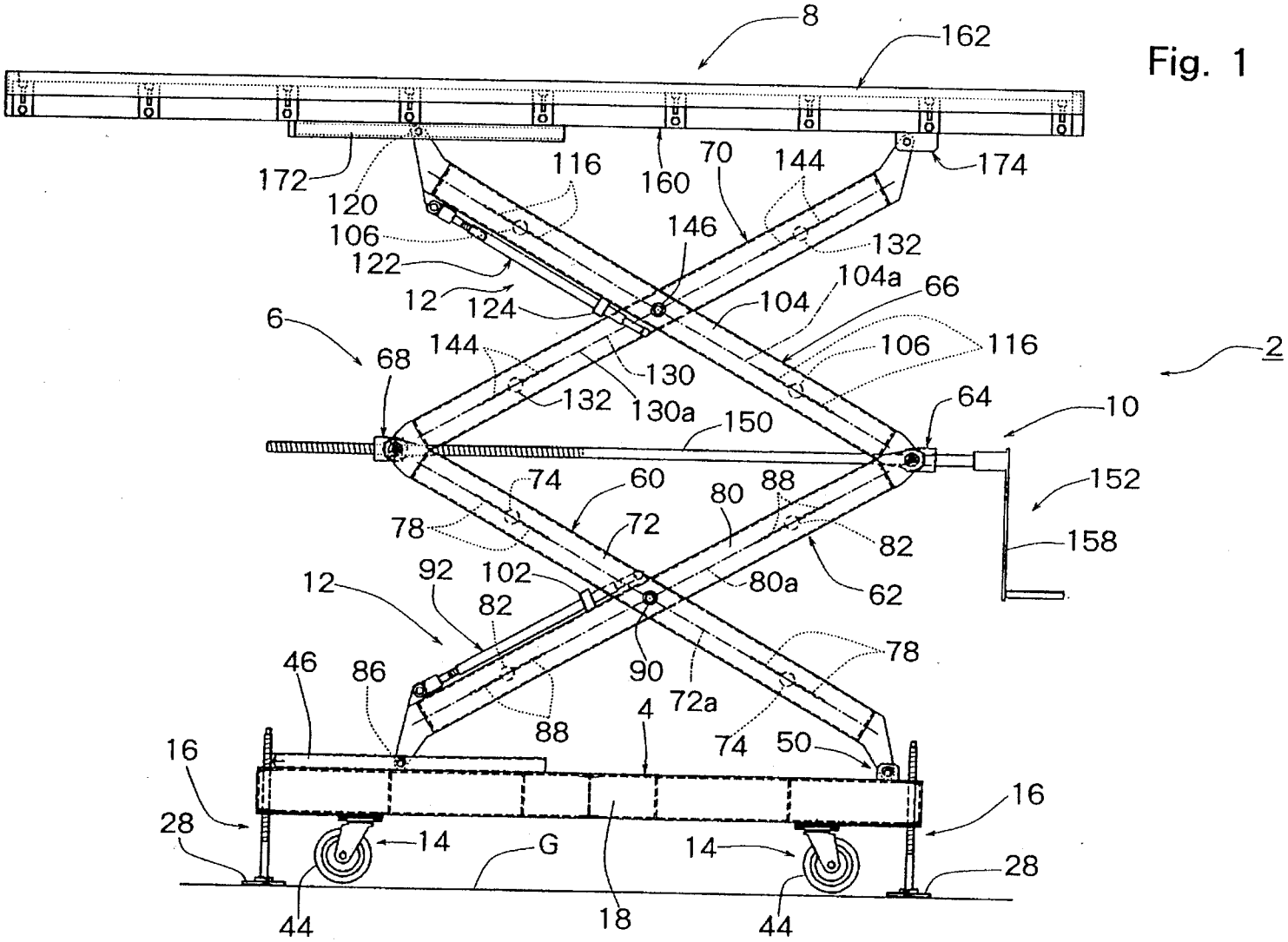
FIG. 1 is a front view illustrating an embodiment of a movable slab form unit constituted according to the present invention.
Figure 2:
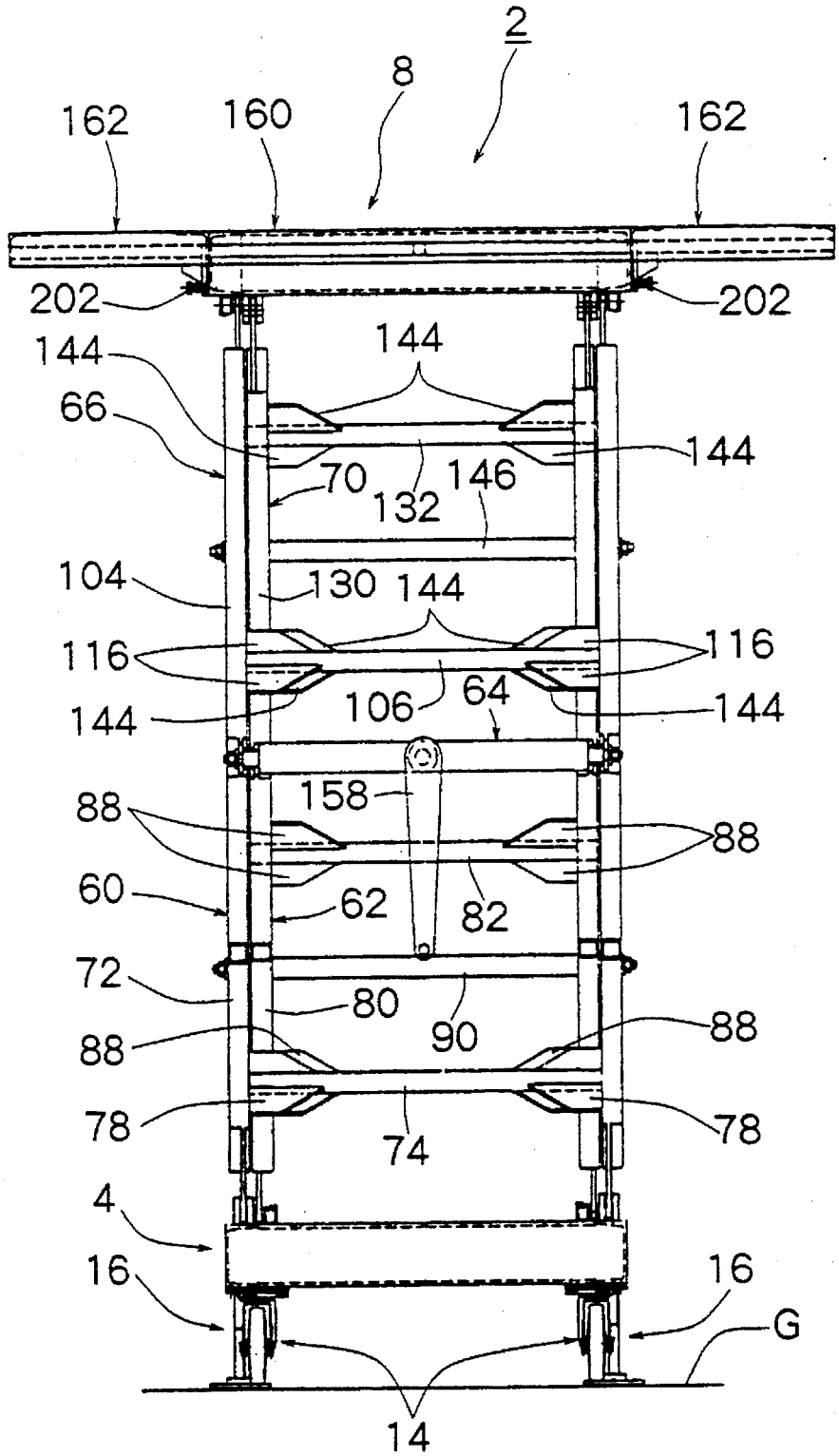
FIG. 2 is a side view of when
Figure 3:
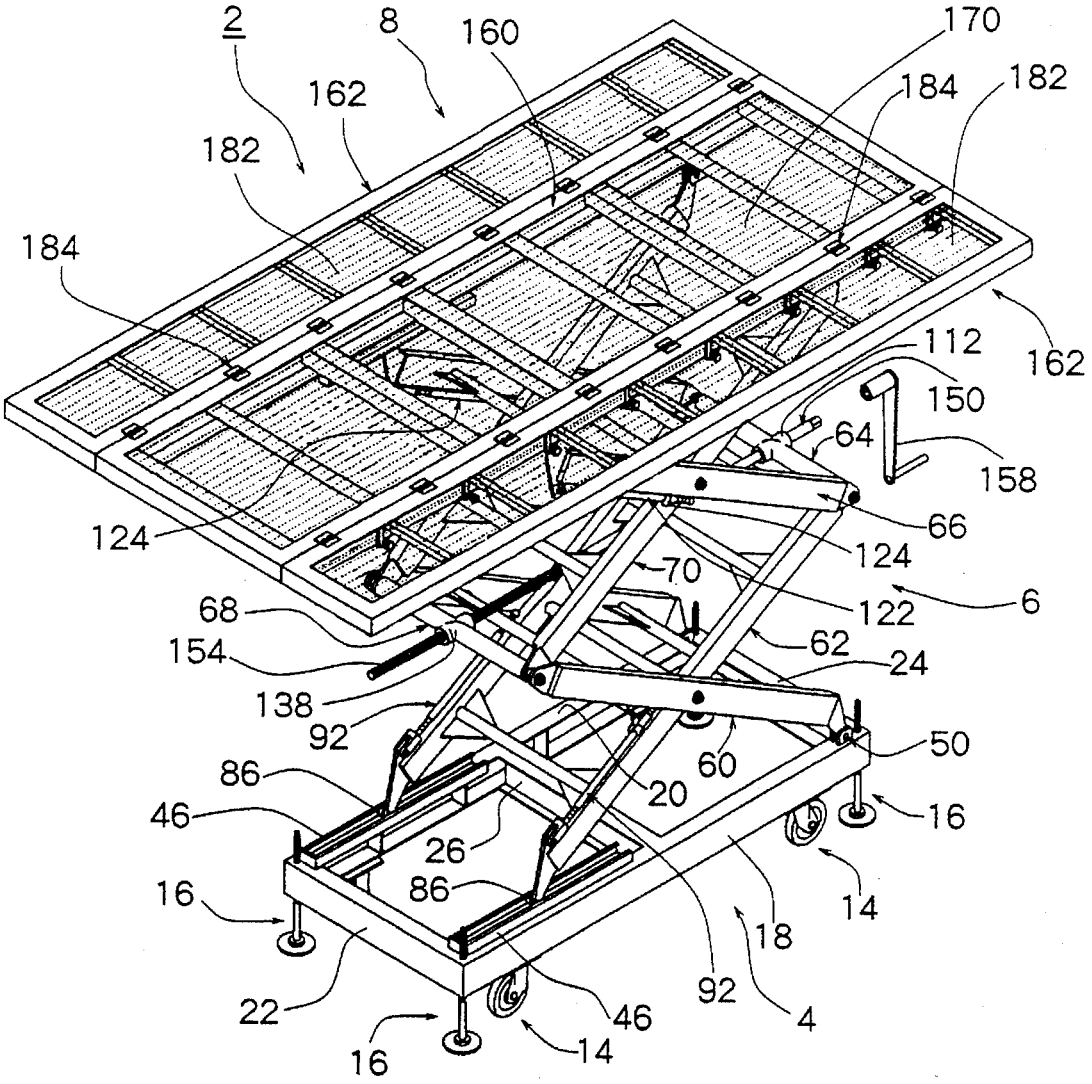
FIG. 3 is a perspective view of the movable slab form unit shown in FIG. 1.
Figure 4:
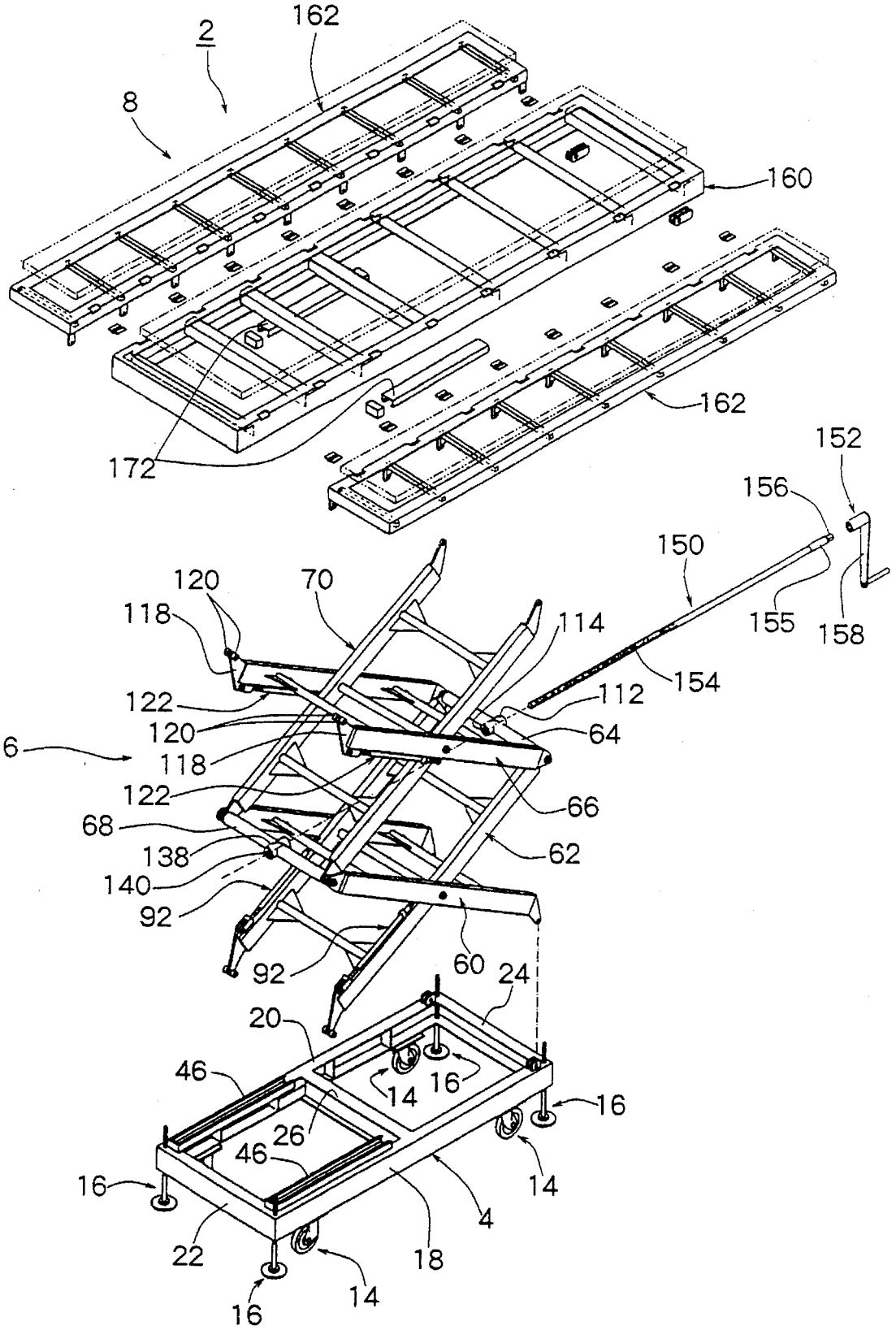
FIG. 4 is a perspective view illustrating, in a disassembled manner, the movable slab form unit shown in FIG. 3.

A movable slab form unit constituted according to the present invention will now be described in detail based upon embodiments with reference to the accompanying drawings. Referring to FIGS. 1 and 2, the movable slab form unit generally designated at 2 comprises a base plate 4, an elevation motion means 6 which is mounted on the base plate 4 and is capable of being raised and lowered in the up-and-down direction, a slab form means 8 mounted on the upper end of the elevation motion means 6, an elevation motion mechanism 10 for raising and lowering the elevation motion means 6, and a stabilizer means 12 for the elevation motion means 6. The base plate 4 includes four swivel castors 14 (which constitute running means) for moving the base plate 4, and four jacks 16 (which constitute jack means) having lower end portions of which the positions can be freely adjusted in the up-and-down direction with respect to a surface G on which it is placed. Described below first is the base plate Referring to FIGS. 3 to 5, the base plate as a whole has a substantially rectangular shape and includes two side frames 18 and 20, end frames 22 and 24 for coupling the end portions of the side frames 18 and 20, and an intermediate frame 26 for coupling intermediate portions of the side frames 18 and 20. The jacks 16 are provided at four corners of the base plate 4. The jacks 16 have substantially the same constitution and, hence, only one of them is described below. Referring chiefly to FIG. 6, the jack 16 includes a base member 28 for defining the lower end portion, and a support rod member 34 which is mounted upright on the base member 28 and has an externally threaded portion 30 and a rotation operation portion 32 that are formed thereon. The base member 28 is constituted by a disk and has a through hole 36 formed at the central portion thereof. The lower end of the support rod member 34 is rotatably supported by the base member 28 via a thrust bearing 38 which is held at a central position of the base member 28 by a holder 40. More concretely, an outer diameter portion of a race on the lower side of the thrust bearing 38 is forcibly fitted into an inner diameter portion of a circular recessed portion formed in the holder 40 which is secured to the base member 28 by welding or by any other securing means. The peripheral portion of the lower surface of the race on the lower side of the thrust bearing 38 is brought into contact with the upper surface of the periphery of the through hole 36 formed in the base member 28. A small diameter portion is formed at the lower end portion of the support rod member 34, the outer diameter surface of the small diameter portion is forcibly fitted into the small diameter portion of the race on the upper side of the thrust bearing 38, and a shoulder portion between the small diameter portion and a large diameter portion of the support rod member 34 is brought into contact with the peripheral portion on the upper surface of the race on the upper side of the thrust bearing 38. The rotation operation portion 32 is constituted by a polygonally-shaped portion i.e., by a square portion in this embodiment, that is formed at the top of the support rod member 34. At four corner portions of the base plate 4 are formed internally threaded portions 42 (see FIG. 8) having a substantially vertical axis.

Each jack 16 is fitted to the base plate 4 by bringing the externally threaded portion 30 of the support rod member 34 into engagement with the corresponding internally threaded portion 42 of the base plate 4. In a state in which the jacks 16 are fitted to the base plate 4, the rotation operation portion 32 of the support rod member 34 is positioned to upwardly protrude beyond the base plate 4. By turning the rotation operation portion 32 using a tool such as a wrench or the like, the support rod member 34 undergoes the rotation to move the base member 28 in the up-and-down direction. Under the base plate 4, therefore, the base member 28 is adjusted for its position in the up-and-down direction with respect to the surface G on which the base plate 4 is placed or, in other words, is adjusted for its position protruded beyond the base plate 4 toward the surface on which the base plate 4 is placed. The rotation operation portion 32 may be constituted by a handle operation portion (not shown) that is integrally provided at a portion where no externally threaded portion 30 is formed. The lower end portion of the support rod member 34 of the jack 16 is rotatably supported by the base member 28 via the thrust bearing 38 and, hence, the support rod member 34 can be turned relatively easily even when a heavy load is exerted thereon.

Figure 5:
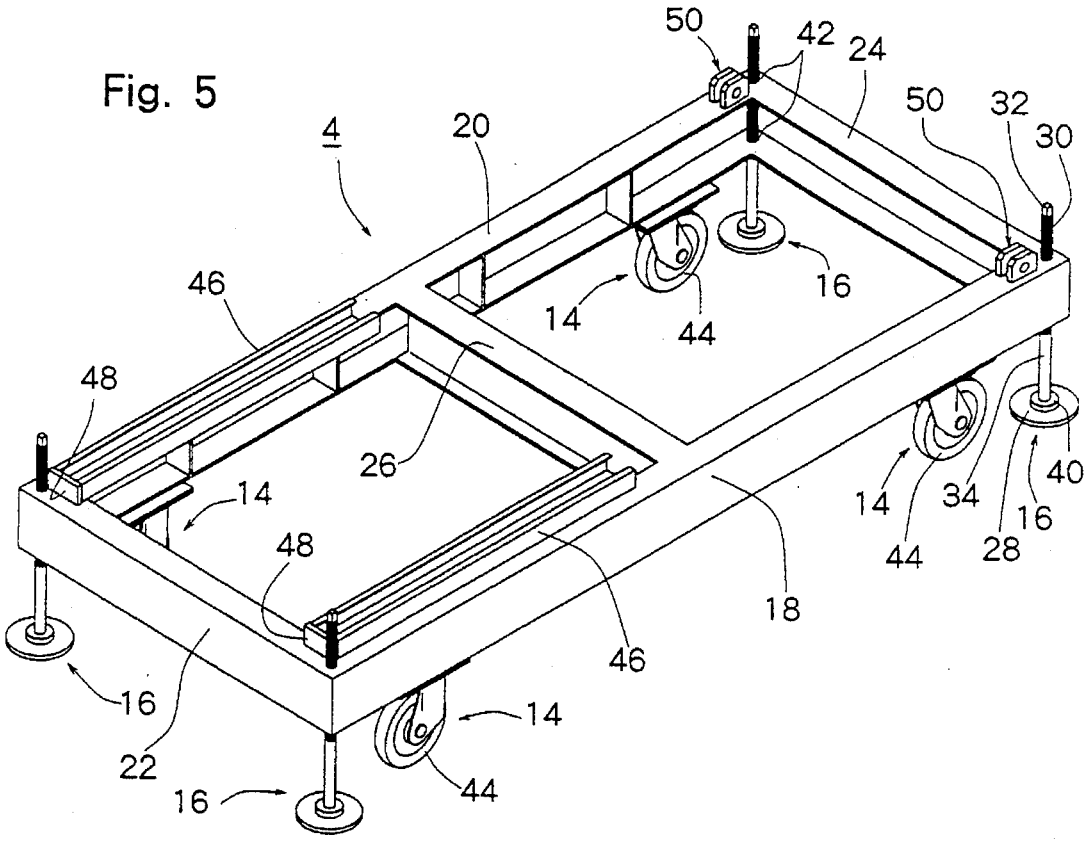
FIG. 5 is a view illustrating a base plate of FIG. 4 on an enlarged scale.
Figure 6:
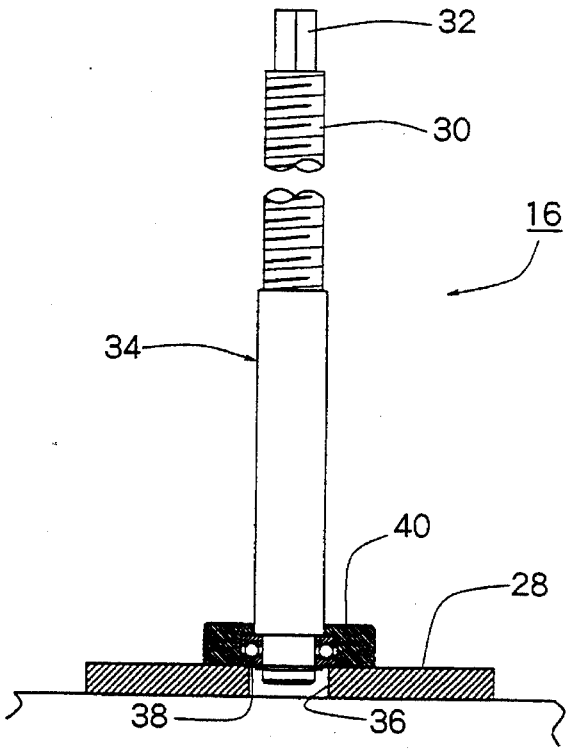
FIG. 6 is a front view showing part of a jack in a cut-away manner.
Figure 7:
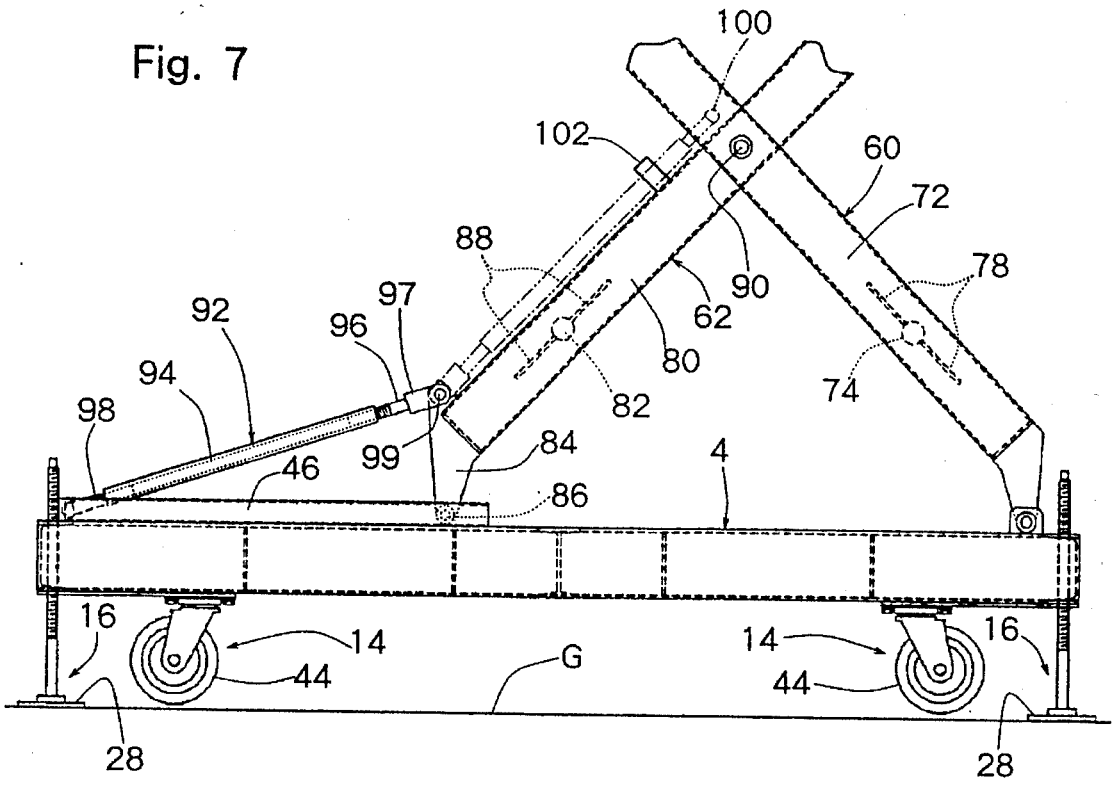
FIG. 7 is a view illustrating the use of a turn buckle.

With reference to FIGS. 5 and 7, the four swivel castors 14 downwardly protrude at portions of one ends and other ends of the side frames 18 and 20. The swivel castors 14 may be of a widely known form including a wheel 44, and have substantially the same constitution. When the positions of base members 28 of the jacks 16 protruded from the base plate 4 are higher than the positions of wheels 44 of the swivel castors 14 that are protruded, the base members 28 do not come in contact with the surface G on which the base plate 4 is placed. Therefore, the base plate 4 is supported by the wheels 44 to move on the surface G on which it is placed. When the positions of the base members 28 protruded from the base plate 4 are lower than the positions of the wheels 44 that are protruded, the base members 28 come into contact with the surface G on which the base plate 4 is placed, and the wheels 44 float over the surface G on which the base plate 4 is placed. Accordingly, the base plate 4 is supported by the jacks 16 so will not to move on the surface G. By operating the jacks 16 in this state, the horizontal level of the base plate 4 can be easily adjusted.

Figure 8:
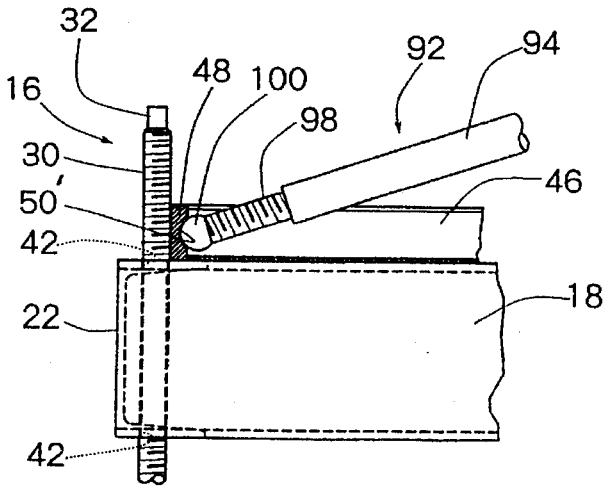
FIG. 8 is a view illustrating an end portion of a support rod means shown in FIG. 7 in a cut-away manner.

Referring to FIGS. 5, 7 and 8, guide rail members 46 (constituting guide rail means) are provided on the upper surfaces on one side of the side frames 18 and 20 extending straight along therewith. The guide rail members 46 have substantially the same constitution and only one of them will be described. The guide rail member 46 has a substantially channel-like shape, upper both ends thereof being folded in a direction to be faced to each other and the central portion thereof being open toward the upper side. An end of the guide rail member 46 is closed by a wall member 48. Inside the wall member 48 is formed an engaging portion 50' (see FIG. 8) which will engage with the other end (spherical portion 100) of a turn buckle 92 that will be described later. The engaging portion 50' consists of a recessed portion of a substantially spherical shape. Support portions 50 having substantially the same constitution are provided on the upper surfaces at the other ends of the side frames 18 and 20. The support portions 50 are constituted by a pair of support plate members that are fixed apart from each other, and support holes having a common axis are formed in the pair of support plate members. The lower ends of a first link 60 that will be described later are pivotably supported by the support portions 50.

With reference to FIGS. 1 to 4 and 9, the elevation motion means 6 includes the first link 60 which is pivotably supported at its lower ends by the base plate 4, a second link 62 which is pivotably coupled to the first link 60 in a crossing manner and is movably supported at its lower ends by the base plate 4, a third link 66 which is pivotably coupled at its lower ends to the upper ends of the second link 62 via a shaft means 64 and is movably coupled at its upper ends to the slab form means 8, and a fourth link 70 which is pivotably coupled to the third link 66 in a crossing manner, pivotably coupled at its lower ends to the upper ends of the first link 60 via a shaft means 68, and is pivotably coupled at its upper ends to the slab form means 10.

The first link 60 includes two links 72 that extend in parallel maintaining a distance, and two lateral frames 74 that couple the links 72 together. Each link 72 is constituted by a square pipe member and is provided at its lower end portion with a to-be-supported portion having a plate-like shape. The to-be-supported portions 76 define the lower ends of the first link 60. In the to-be-supported portions 76 are formed to-be-supported holes having a common axis. The to-be-supported portions 76 are pivotably supported by the corresponding support portions 52 provided on the base plate 4. That is, each to-be-supported portion 76 is disposed between a pair of support plate members in the corresponding support portion 52. A support pin member which is not shown is inserted in the to-be-supported hole of the to-be-supported portion 76 and in the support holes of the pair of support plate members, that are aligned with each other. Plate-like coupling portions 73 are provided at upper end portions of the links 72. The coupling portions 73 define the upper end of the first link 60. Each lateral frame 74 is formed of a pipe member of which both ends are secured to the inner side surfaces of the corresponding links 72. Two pieces of reinforcing plates 78 of substantially a right-angled triangular shape are secured between the outer peripheral surfaces at both ends of the pipe members and the inner side surfaces of the corresponding links 72. In each of the two pieces of reinforcing plates 78, one of the two sides forming the right angle is located at a position opposite by 180 degrees on the outer peripheral surface of the pipe member and another side is positioned straight on the inner side surface of the link 72 along the lengthwise direction. The reinforcing plates 78 have substantially the same constitution and constitute part of the stabilizer means 12 for the elevation motion means 6.

A second link 62 includes two links 80 that extend in parallel maintaining a distance and two lateral frames 82 for coupling the links 80 together. Each link 80 is constituted by a square pipe member. A plate-like to-be-supported portion 84 is provided at the lower end of each of the links 80. The two-be-supported portions 84 have substantially the same constitution and define the lower ends of the second link 62. On both sides at the ends of the to-be-supported portions 84 are pivotably supported guide rollers 86 (constituting guide roller means). The guide rollers 86 of the to-be-supported portions 84 are brought into movable engagement with the corresponding guide rail members 46 provided on the base plate 4. Plate-like coupling portions 81 are provided at the upper ends of the links 80, and defines the upper end of the second link 62. The lateral frames 82 are formed of pipe members of which both ends are secured to the inner side surfaces of the corresponding links 80. Two pieces of reinforcing plates 88 of substantially a right-angled triangular shape are secured between the outer peripheral surfaces at both ends of the pipe members and the inner side surfaces of the corresponding links 80. In each of the two pieces of reinforcing plates 88, one of the two sides forming the right angle is located at a position opposite by 180 degrees on the outer peripheral surface of the pipe member and another side is positioned straight on the inner side surface of the link 80 along the lengthwise direction. The reinforcing plates 88 have substantially the same constitution and constitute part of the stabilizer means 12 for the elevation motion means 6.

A maximum size in the lateral direction of the links 80 of the second link 62 (lateral width of the second link 62) is smaller than the distance between the inner sides of the links 72 of the first link 60. Therefore, the second link 62 is positioned on the inner sides of the links 72 of the first link 60, and is pivotably coupled thereto intersecting the first link 60 in an X-shape. More concretely, a lateral shaft 90

(constituting a coupling pin) is secured nearly at intermediate portions in the lengthwise direction of the links 80 of the second link 62. Both ends of the lateral shaft 90 outwardly protrudes beyond the sides of the corresponding links 80, and the corresponding links 72 of the first link 60 are pivotably coupled to the protruded portions.

Figure 9:
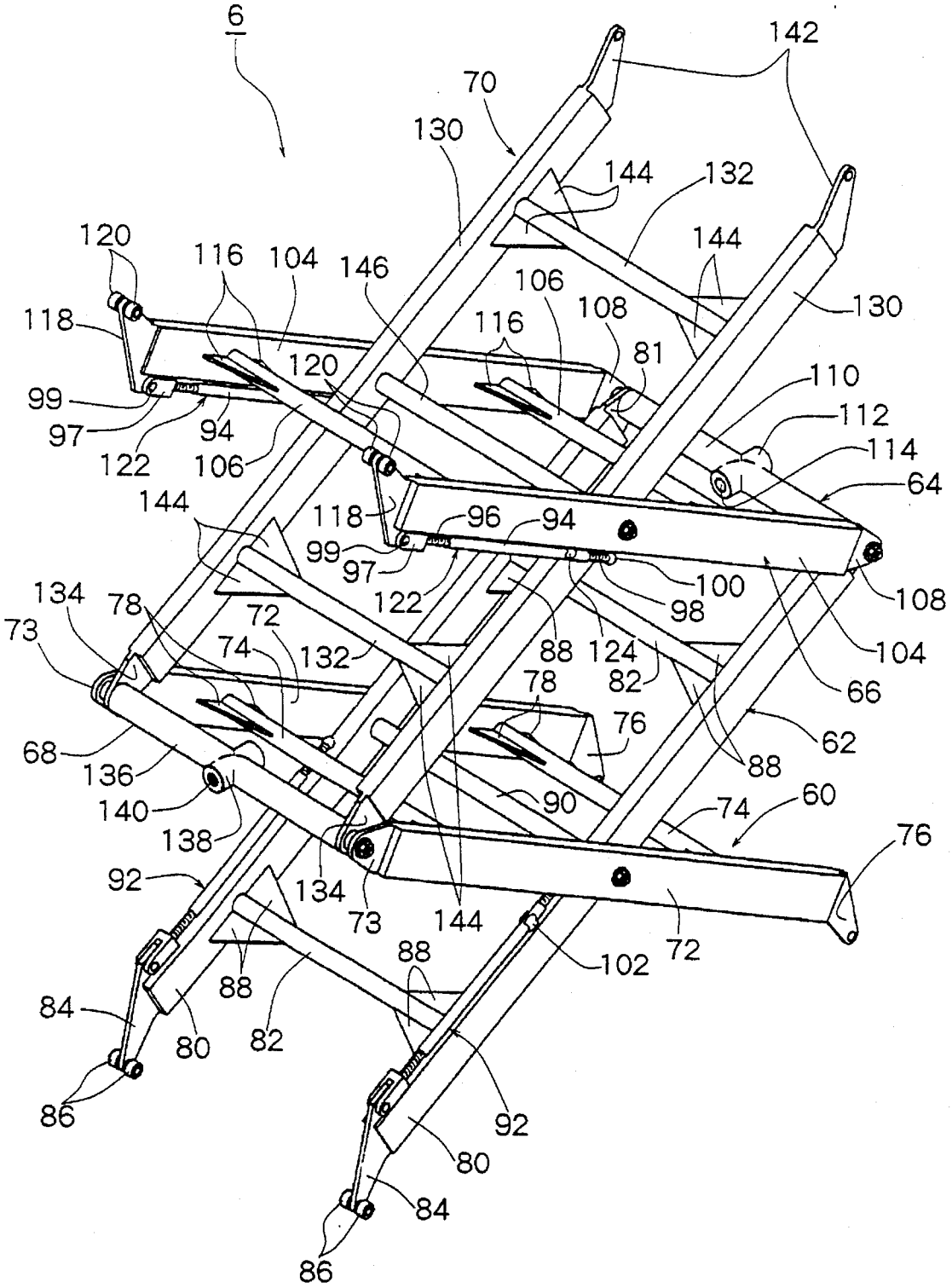
FIG. 9 is a view illustrating an elevation motion means of FIG. 4 on an enlarged scale.

Referring to FIGS. 7 to 9, the ends of the to-be-supported portions 84 on the side opposite to the portions where the guide rollers 86 are mounted upwardly protrude beyond the corresponding links 80, and ends of the turn buckles 92 that constitute support rod means are pivotably coupled to the protruded portions. The turn buckles 92 have substantially the same constitution and only one of them will be described below. The turn buckle 92 has a sleeve 94, a first threaded rod member 96 screwed to an end portion of the sleeve 94, and a second threaded rod member 98 screwed to the other end portion of the sleeve 94. A right-handed screw (internal thread) is formed in one end portion of the sleeve 94, a left-handed screw (internal thread) is formed in the other end portion thereof, while a right-handed screw (external thread) is formed on the first threaded rod member 96, and a left-handed screw (external thread) is formed on the second threaded rod member 98. A fork portion 97 is formed at an end portion of the first threaded rod member 96, and is pivotably coupled to the to-be-supported portion 84 by a pin 99 with the protruded portion of the to-be-supported portion 84 being interposed therebetween. A spherical portion 100 is formed at an end portion of the second threaded rod member 98. The spherical portion 100 is of a shape that is adapted to the recessed portion in the engaging portion 50 formed in the wall member 48 of the guide rail member 46. That is, the spherical portion 100 can be detachably engaged with the engaging portion 50. It will be easily comprehended from the foregoing description that the length in the axial direction of the turn buckle 92 can be easily adjusted by turning the sleeve 94. U-shaped clips 102 (constituting clip means) are provided on the upper surfaces of the links 80. The clips 102 have substantially the same constitution, and the turn buckles 92 are detachably held by the links 80 by means of the corresponding clips 102.

Referring to FIGS. 1 to 4 and 9, the third link 66 includes two links 104 that extend in parallel maintaining a distance, and two lateral frames 106 for coupling these links 104. Each link 104 is constituted by a square pipe member. Plate-like coupling portions 108 are provided at the lower ends of the links 104, and define the lower end of the third link 66. The coupling portions 108 are pivotably coupled via shaft means 64 to the corresponding coupling portions 81 provided at the upper ends of the links 80 of the second link 62. More concretely, the distance between the coupling portions 108 is larger than a maximum size between the coupling portions 81 in the lateral direction. A shaft means 64 is pivotably supported between the inner sides of the coupling portions 81, both ends of the shaft means 64 outwardly protruding beyond the sides of the coupling portions 81, and the corresponding coupling portions 108 are rotatably coupled to these protruded portions. That is, the coupling portions 108 are positioned on the outside of the corresponding coupling portions 81 being overlapped thereon. The shaft means 64 includes a pipe member 110 and a boss 112 formed at a central portion in the axial direction of the pipe member 110 intersecting at right angles thereto. A through hole 114 is formed in the boss 112. The lateral frames 106 are formed of pipe members of which both ends are secured to the inner side surface of the corresponding links 104.

Two pieces of reinforcing plates 116 of substantially a right-angled triangular shape are secured between the outer peripheral surfaces at both ends of the pipe members and the inner side surfaces of the corresponding links 104. In each of the two pieces of reinforcing plates 116, one of the two sides forming the right angle is located at a position opposite by 180 degrees on the outer peripheral surface of the pipe member and another side is positioned straight along the inner side surface of the link 104 in the lengthwise direction. The reinforcing plates 116 have substantially the same structure and constitute a portion of the stabilizer means 12 for the elevation motion means 6. Plate-like support portions 118 are provided at upper ends of the links 104 and define the upper end of the third link 66. On both sides at the ends of the support portions 118 are rotatably supported guide rollers 120 (constituting guide roller means) having a common axis. The guide rollers 120 of the support portions 118 are movably engaged with the corresponding guide rail members 172 (mentioned later) provided in the slab form means 8.

Referring to FIGS. 1 and 9, the ends of the support portions 118 on the side opposite to the portion mounting the guide rollers 120 downwardly protrude beyond the corresponding links 104, and ends of turn buckles 122 constituting the support rod means are pivotably coupled to the protruded portions. The turn buckles 122 have substantially the same constitution which is substantially the same as that of the above-mentioned turn buckles 92. Accordingly, the portions of the turn buckle 122 same as those of the turn buckle 92 are denoted by the same reference numerals and their description is not repeated unless otherwise needed. A fork portion 97 of a first threaded rod member 96 of each turn buckle 122 is pivotably coupled by a pin 99 to the support portion 118 with the protruded portion of the support portion 118 interposed therebetween. A spherical portion 100 of the turn buckle 122 is of a shape that can be adapted to a recessed portion in the engaging portion 50 formed in the wall member 48 of the guide rail member 172 that will be described later. That is, the spherical portion 100 can be detachably engaged with the engaging portion 50. U-shaped clips 124 (constituting clip means) are provided on the upper surfaces of the links 104. The clips 124 have substantially the same constitution which is substantially the same as that of the above-mentioned clips 102. Each turn buckle 122 is detachably held by the link 104 by means of the corresponding clip 124.

Referring to FIGS. 1 to 4 and 9, the fourth link 70 includes two links 130 extending in parallel maintaining a distance, and two lateral frames 132 coupling these links 130 together. Each link 130 is constituted by a square pipe member. Plate-like coupling portions 134 are provided at the lower ends of the links 130. The coupling portions 134 have substantially the same constitution and define the lower end of the fourth link 70. The coupling portions are pivotably coupled via shaft means 68 to the corresponding coupling portions 73 provided at the upper ends of the links 72 of the first link 60. More concretely, a maximum size between the coupling portions 134 in the lateral direction is smaller than the distance between the coupling portions 73. A shaft means 68 is pivotably supported between the inner sides of the coupling portions 134, both ends thereof outwardly protruding beyond the sides of the coupling portions 134, and the corresponding coupling portions 73 are pivotably coupled to these protruded portions. That is, the coupling portions 73 are positioned on the outer sides of the corresponding coupling portions 134 in a manner overlapped thereon. The shaft means 68 includes a pipe member 136 and a boss 138 provided at a central portion in the axial direction of the pipe member 136 intersecting at right angles thereto. A through hole 140 is formed in the boss 138. An internal thread is formed in the inner periphery of the through hole 140 which is positioned along the same axis as the through hole 114 of the above-mentioned shaft means 64. Plate-like support portions 142 are provided at the upper ends of the links 130 and define the upper end of the fourth link 70. In the support portions 142 are formed support holes having a common axis. The support portions 142 are pivotably coupled to corresponding to-be-supported portions 174 (mentioned later) that are formed on the lower side of the slab form means 8. The lateral frames 132 are formed of pipe members of which both ends are secured to the inner side surfaces of the corresponding links 130.

Two pieces of reinforcing plates 144 of substantially a right-angled triangular shape are secured between the outer peripheral surfaces at both ends of the pipe members and the inner side surfaces of the corresponding links 130. In each of the two pieces of the reinforcing plates 144, one of the two sides forming the right angle is located at a position opposite by 180 degrees on the outer peripheral surface of the pipe member and the other side is positioned straight on the inner side surface of the link 130 along the lengthwise direction. The reinforcing plates 144 have substantially the same constitution, and constitutes a portion of the stabilizer means 12 for the elevation motion means 6. A maximum size in the lateral direction between the links 130 of the fourth link 70 (lateral width of the fourth link 70) is smaller than the distance between the inner sides of the links 104 of the third link 66. Therefore, the fourth link 70 is positioned on the inside of the links 104 of the third link 66 and is pivotably coupled to the third link 66 intersecting relative thereto in an X-shape. More concretely, a lateral shaft 146 (constituting coupling pin) is secured to nearly the intermediate portions in the lengthwise direction of the links 130 of the fourth link 70. Both ends of the lateral shaft 146 outwardly protrude beyond the sides of the links 130, and the corresponding links 104 of the third link 66 are pivotably coupled to these protruded portions.

Referring to FIGS. 1 to 4, the elevation motion mechanism 10 includes a threaded operation rod member 150 supported by shaft means 64 and 68 of the elevation motion means 6 at right angles thereto, and an operation means 152 for turning the operation rod member 150 so that the shaft means 68 is moved to approach, or separate away from, the shaft means 64 along the operation rod member 150. The operation rod member 150 has an externally threaded portion 154 having an external thread formed on one end side thereof and a shaft portion 155 on the other end side thereof, that has a square portion 156 formed at the end thereof. The operation means 152 is constituted by an operation handle 158 which is detachably engaged with the square portion 156 of the operation rod member 150 to rotate the operation rod member 150. The operation member 150 extends penetrating through the boss 112 of the shaft means 64 and the boss 138 of the shaft means 68. The externally threaded portion 154 of the operation rod member 150 is screwed into the through hole 140 of boss 138 of shaft means 68 in which the internal thread is formed, and the shaft portion 155 is rotatably engaged in the through hole 114 in the boss 112 of shaft means 64. Snap rings that are not shown are fitted to the shaft portion 155 at both end positions of the boss 112, so that the shaft portion 155 will not move in the axial direction relative to the boss 112 (i.e., relative to the shaft means 64). By turning the operation handle 158 upon engaging with the square portion 156 of the operation rod member 150, the shaft means 68 moves in the direction to approach, or separate away from, the shaft means 64 along the externally threaded portion 154 of the operation rod member 150. This movement causes the end portions of the first link 60 and the second link 62, and the end portions of the third link 66 and the fourth link 70 to move in the direction to approach, or separate away from, each other.

Figure 10:
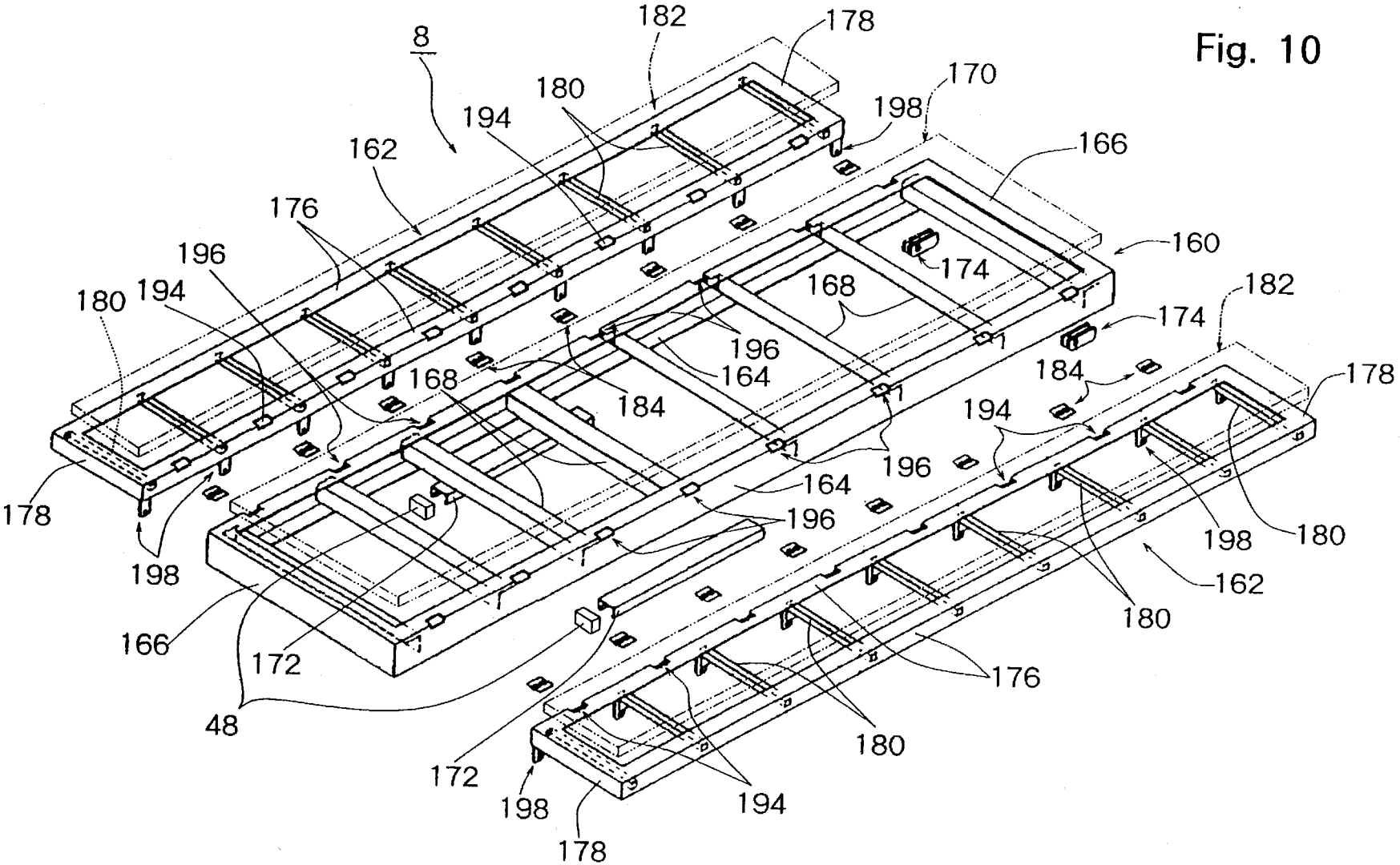
FIG. 10 is a view illustrating a slab form means of FIG. 4 on an enlarged scale.
Figure 11:
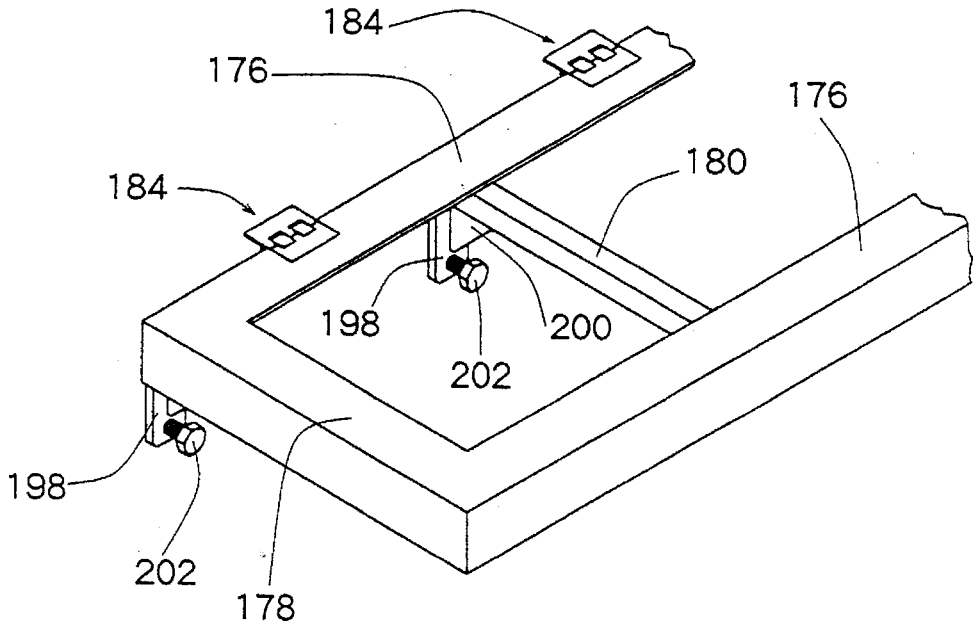
FIG. 11 is a partial perspective view of a side form of FIG. 10.

Referring to FIGS. 1 to 4 and 10, the slab form means 8 includes a center form 160 having a substantially rectangular shape and a substantially flat upper surface, and two side forms 162 which are disposed on both sides of the center form 160 and having substantially flat upper surfaces. The side forms 162 have substantially a rectangular shape. Referring chiefly to FIG. 10, the center form 160 includes two side frames 164, end frames 166 for coupling the ends of the side frames 164, and a plurality of intermediate frames 168 coupling intermediate portions of the side frames 164. The side frames 164 and the end frames 166 are constituted by grooved frame members with their open portions being faced to one another. The intermediate frames 168 are constituted by L-shaped members with their ends being welded to the bottom portions (vertical portions) of the grooved frames of side frames 164. As will be obvious from the above description and the drawings, on the upper surface side of the center form 160 is formed a substantially rectangularly-shaped opening of which the peripheral edges are defined by the side frames 164 and by the end frames 166. A predetermined difference of height is formed between the upper surfaces of the intermediate frames 168 and the upper surfaces of the side frames 164 and of end frames 166. In the opening is inserted a panel member 170 (constituting panel means) of a synthetic resin having a substantially flat upper surface. The panel member 170 has such a size that it is nearly closely fitted to the opening and is placed with its lower surface on the upper surfaces of the intermediate frames 168, and is further secured using suitable securing means (such as screws that are detachably secured from the lower side of the intermediate frames 168). In this state, the upper surfaces of the side frames 164, end frames 166 and panel member 170 are positioned to be substantially flush with each other.

The panel member 170 is molded as a unitary structure using a synthetic resin such as vinyl chloride, acrylic resin, polypropylene, polyethylene, polycarbonate, polystyrene or the like material. It is desired that the synthetic resin is transparent. Here, the transparency may be a high degree of transparency such as of a glass, as well as transparency of milky white color or any other color that maintains transparency to such an extent that permits a worker to observe by eyes from the lower side the concrete that is poured onto the upper surface of the panel member 170. The plastic resin panel member 170 used as the form can be readily parted from the concrete slab and permits stains to be removed with ease. By using a transparent synthetic resin, furthermore, the state where the concrete is poured (filled) can be visually recognized from the lower side of the panel member 170.

On the lower side of one end side of the center form 160 are provided guide rail members 172 (constituting guide rail means) extending straight substantially along the side frames 164. The guide rail members 172 have substantially the same constitution which is substantially the same as that of the aforementioned guide rail members 46. That is, the guide rail members 172 have substantially a channel-like shape having folded portions that are faced to each other at lower both end portions thereof with their central portions being open toward the lower side. One end of the guide rail member 172 is closed by a wall member 48 (see FIG. 8). On the inside of the wall member 48 is formed an engaging portion 50 (see FIG. 8) which will detachably engage with the other end of the above-mentioned turn buckle 122. The engaging portion 50 has a recessed portion of a substantially spherical shape. Guide rollers 120 at the support portions 118 of the third link 66 are movably engaged with the corresponding guide rail members 172. To-be-supported portions 174 having substantially the same constitution are provided on the lower sides of the other end side of the center form 160. The to-be-supported portions 174 have substantially the same constitution as the support portions 52 and are not described here. The to-be-supported portions 174 is pivotably supported by the upper end portions of the fourth link 70. Being constituted as described above, the central form 160 is mounted (supported) at the upper ends of the elevation motion means 6.

The side forms 162 have substantially the same constitution and only one of them will be described. The side form 162 includes two side frames 176, end frames 178 for coupling the ends of the side frames 176, and a plurality of intermediate frames 180 for coupling the intermediate portions of the side frames 176. The side frames 176 and end frames 178 are constituted by L-shaped members which are so arranged that the insides at the right-angled portions thereof are faced to one another. Each intermediate frame 180 is constituted by a square pipe member with their end portions being welded to the inner sides at substantially a vertical portion of each of the side frames 176. As will be obvious from the above description and the drawings, on the upper surface side of the side form 162 is formed a substantially rectangularly shaped opening of which the peripheral edges are defined by the side frames 176 and end frames 178. A predetermined difference of height is formed between the upper surfaces of the intermediate frames 180 and the upper surfaces of the side frames 176 and of end frames 178. In the opening is inserted a panel member 182 (constituting panel means) made of a synthetic resin having a substantially flat upper surface. The panel member 182 has such a size that it is nearly closely fitted to the opening, and is placed with its lower surface on the upper surfaces of the intermediate frames 180, and is further secured by a suitable securing means (e.g., screws that are detachably secured from the lower side of the intermediate frames 180). In this state, the upper surfaces of the side frames 176, end frames 178 and panel member 182 are positioned to be substantially flush with one another. The panel member 182 is constituted by the same material as the above-mentioned panel member 170. It is desired that the panel member 182 is made of a transparent material on account of the reasons as described above.

Figure 12:
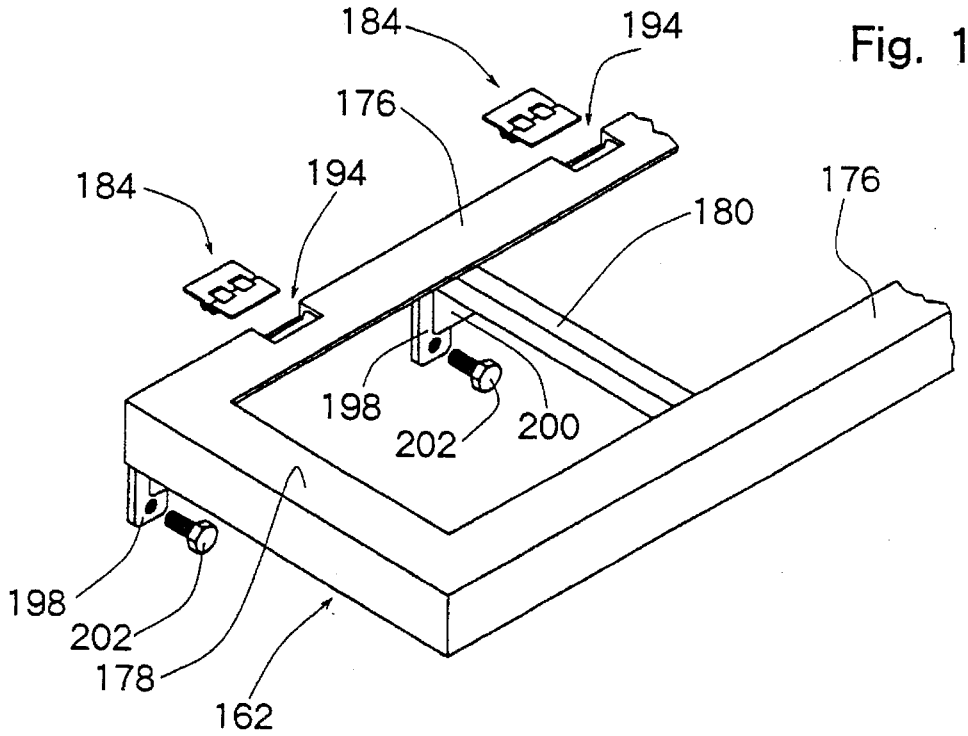
FIG. 12 is a view illustrating, in a disassembled manner, the side form of FIG. 11.
Figure 13:
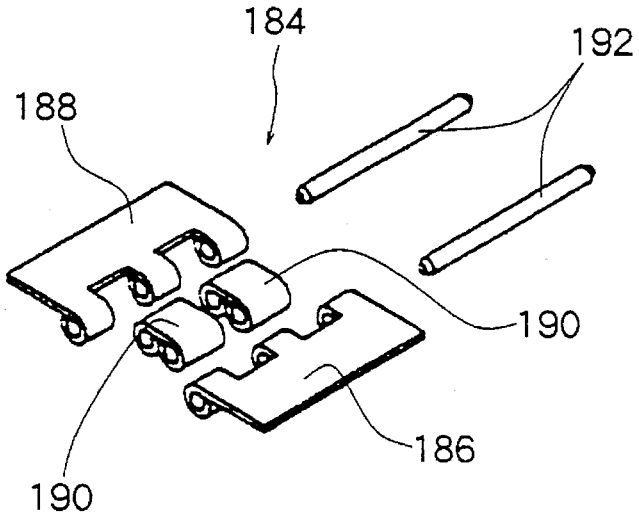
FIG. 13 is a view illustrating a hinge of FIG. 12 in a disassembled manner.

The side forms 162 are coupled to the corresponding side portions of the center form 160 via a plurality of hinges 184 (constituting hinge means) so as to be selectively brought into a folded state (see FIG. 16) where their upper surfaces are brought into contact with the upper surface of the center form 160 and into a use state (see FIGS. 1 to 3) where their upper surfaces are positioned to be substantially flush with the upper surface of the center form 160. The hinges 184 are substantially of the same constitution and only one of them will be described. Referring to FIG. 13, the hinge 184 has a first coupling member 186, a second coupling member 188, two intermediate members 190, and two hinge pins 192. The first coupling member 186 and the second coupling member 188 have substantially the same constitution, the intermediate members 190 have substantially the same constitution, and the hinge pins 192 have substantially the same constitution. The first coupling member 186, the second coupling member 188, and the intermediate members 190 have substantially flat upper surfaces. As will be obvious from FIG. 12, the first coupling member 186 and the second coupling member 188 are pivotably coupled together via two intermediate members 190 and two hinge pins 192, thereby to constitute the hinge 184. The hinge 184 is so constituted that the flat upper surfaces of the first coupling member 186, second coupling member 188 and intermediate members 190 are positioned to be substantially flush with one another, and that the first coupling member 186 and second coupling member 188 are turned on their corresponding hinge pins 192 so that their flat surfaces are overlapped one upon the other.

Portions coupling each of the side forms 162 to the center form 160 have substantially the same constitution and, hence, constitution of the portions coupling one of the side forms 162 to the center form 160 will be described. Referring to FIGS. 10 to 14, a plurality of recessed portions 194 are formed in one side frame 176 of the side form 162. A plurality of recessed portions 196 are formed in the side frames 164 of the center form 160. The recessed portions 194 and 196 have substantially the same constitution and are formed by a press. The first coupling member 186 of the hinge 184 is inserted in the recessed portion 194 in the side frame 176 of the side form 162 and is secured thereto by screws that are not shown. The second coupling member 188 is inserted in the recessed portion 196 in the side frame 164 of the center form 160 and is secured thereto by screws that are not shown. In the thus mounted state, the center form 160 and the side form 162 are so coupled that there exists substantially no gap between their corresponding side portions and that the upper surfaces of the hinges 184 are positioned substantially flush with the upper surfaces of the center form 160 and side form 162.

Figure 14:
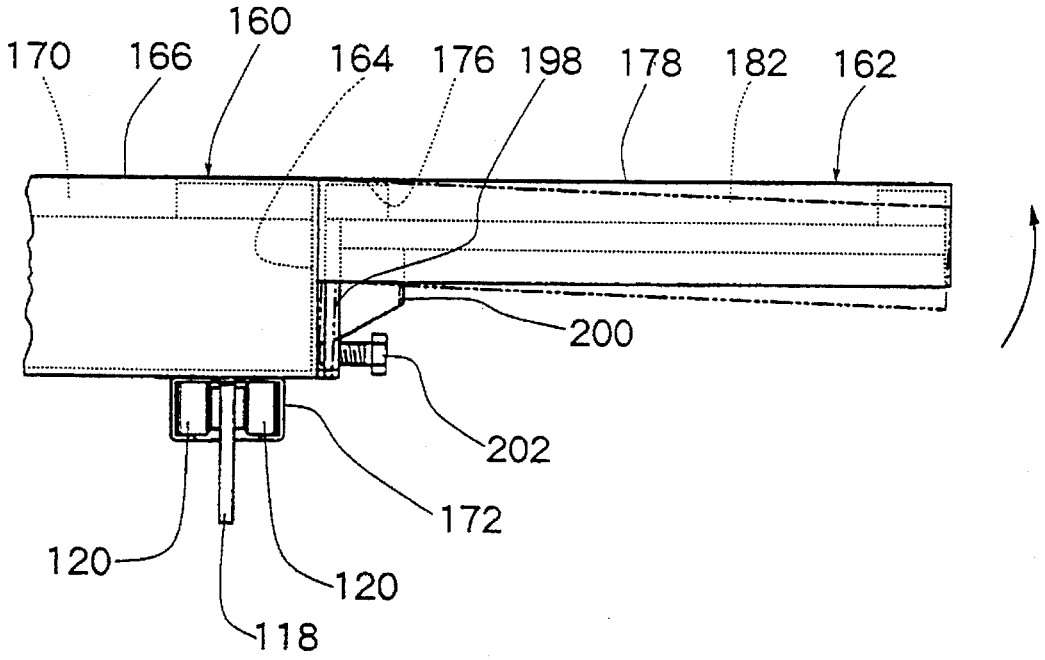
FIG. 14 is a side view schematically illustrating a portion coupling the center form and the side form in the slab form means shown in FIG. 2.
Figure 15:
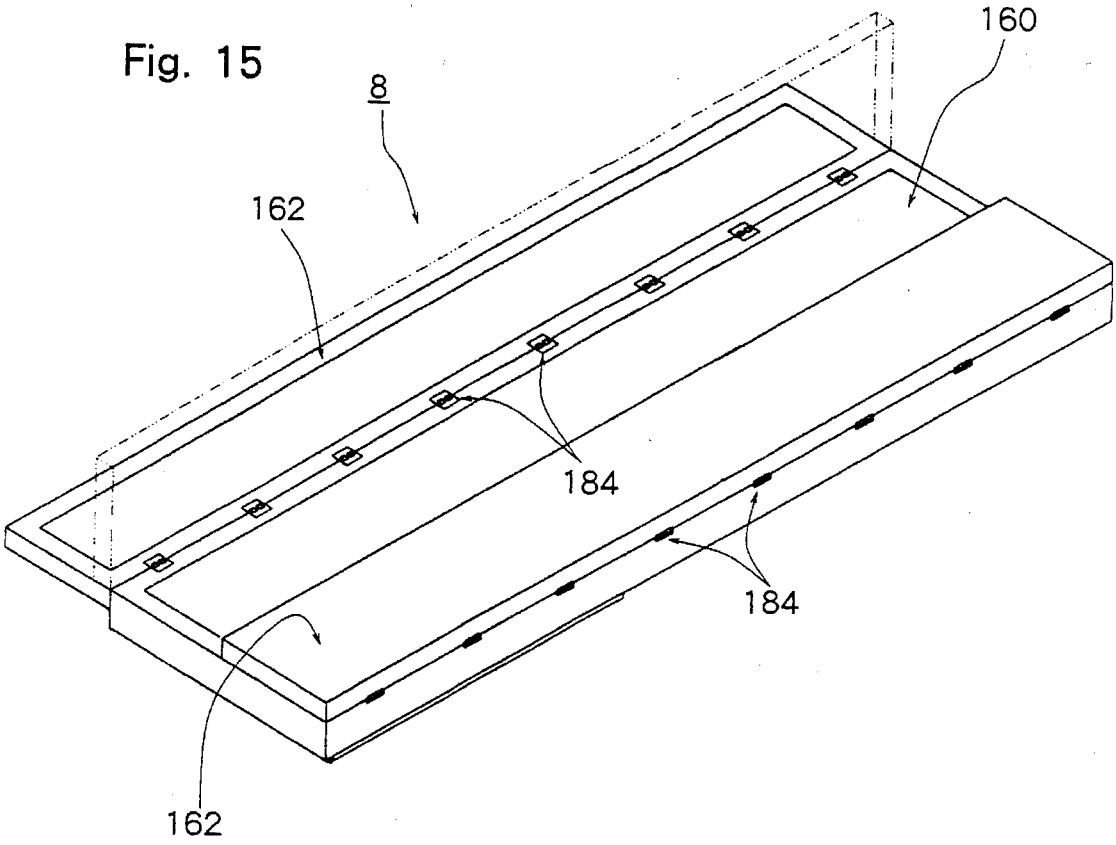
FIG. 15 is a perspective view schematically illustrating a positional relationship of the side forms with respect to the center form.
Figure 16:
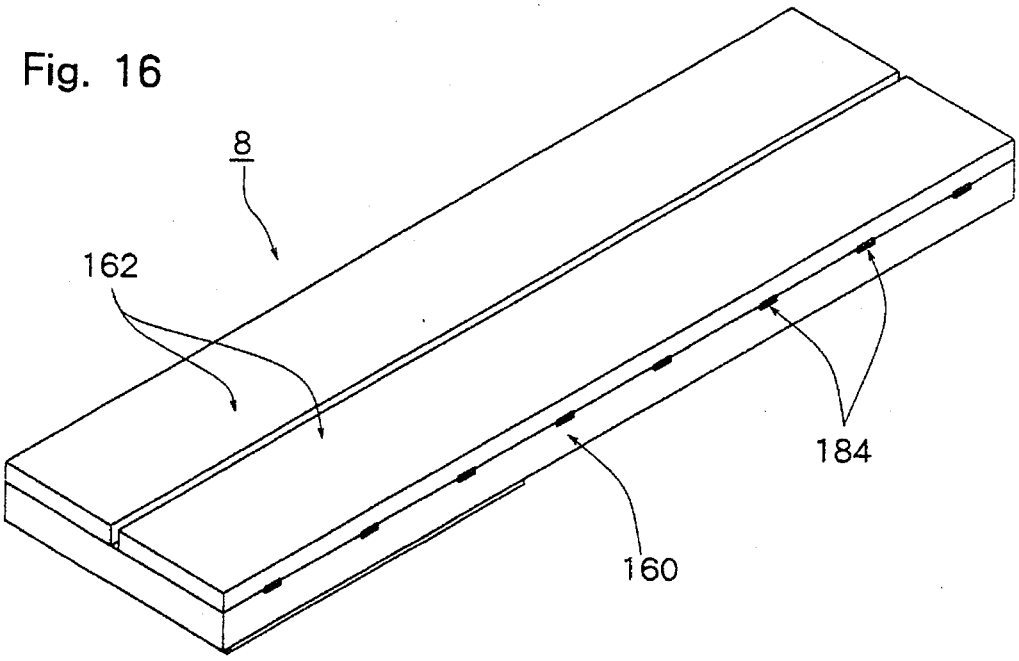
FIG. 16 is a perspective view schematically illustrating another positional relationship of FIG. 15.

Referring chiefly to FIGS. 10 to 12 and FIG. 14, a plurality of downwardly protruding support plates 198 (constituting support portions) are provided for the side portions, i.e. side frames 176 of the side forms 162 faced to the side portions, i.e. side frames 164 of the center form 160. The support plates 198 are fitted to the side frames 176 in a manner to hang down from the inner side of vertical portions of the side frames 176. The fitted positions are at the end portions of the intermediate frames 180, and reinforcing plates 200 are provided between the intermediate frames 180 and the support plates 198. An adjusting bolt 202 is screwed into each of the support plates 198. Referring to FIG. 14, at positions where the side forms 162 are in use, the ends of the adjusting bolts 202 are moved in the axial direction to come into contact with the vertical portions of the corresponding side frames 164 of the center form 160, so that the upper surfaces of the side forms 162 are positioned to be substantially in flush with the upper surface of the center form 160. As will be obvious from FIG. 14, the thickness (height) of the side forms 162 is smaller than the thickness of the center form 160 (height of the side frames 164). FIG. 15 illustrates a state where one of the side forms 162 is folded onto the upper surface of the center form 160, and FIG. 16 illustrates a state where both of the side forms 162 are folded onto the upper surface of the center form 160. The length of the side forms 162 in the lengthwise direction is nearly the same as that of the center form 160, and the width of the side forms 162 is nearly one-half that of the center form 160.

The slab form means 8 includes panel means (panel members 170, 182) having substantially flat upper surfaces. The panel means which is made of a synthetic resin can be readily parted from the concrete to improve operation efficiency. Moreover, contamination on the surface of the slab form can be removed to obtain a clean surface. Besides, the concrete surfaces can be finished more smoothly than ever before. In this case, furthermore, use is not made of a veneer which is subject to be worn out and, hence, the members constituting the form can be used semipermanently making it possible to save resources to a striking degree. Moreover, the operation efficiency is improved and wear and tear expenses are decreased. With the panel means being made of a transparent synthetic resin, the condition of being filled with concrete can be observed by eyes from the lower side, making it possible to discover any defect at an early time while concrete is poured and to correct the defect immediately. Accordingly, slabs having high quality can be reliably formed.

In a state in which the thus constituted slab form means 8 is mounted on the upper ends of the elevation motion means 6, the upper surface of the slab form means 8 is positioned to be substantially horizontal as will be described later. By the raising or lowering operation of the elevation motion means 6, the slab form means 8 is moved up or down with its upper surface while being maintained substantially in a horizontal state. This is realized based upon the constitution of the elevation motion means 6. That is, in the elevation motion means 6 as will be obvious from FIG. 1, the links 72 of the first link 60 and the links 104 of the third link 66 are arranged substantially in parallel with each other, and the links 80 of the second link 62 and the links 130 of the fourth link 70 are arranged substantially in parallel with each other. The axis of the lateral shaft (coupling pin) 90 is positioned at an intersecting point of a center line 72*a* of the links 72 of the first link 60 in the lengthwise direction and a center line 80*a* of the links 80 of the second link 62 in the lengthwise direction to couple them together, and the axis of the lateral shaft (coupling pin) 146 is positioned at an intersecting point of a center line 104*a* of the links 104 of the third link 66 in the lengthwise direction and a center line 130*a* of the links 130 of the fourth link 70 in the lengthwise direction to couple them together. Furthermore, the axis of the shaft means 68 is positioned at an intersecting point of the center line 72*a* of the links 72 of the first link 60 in the lengthwise direction and the center line 130*a* of the links 130 of the fourth link 70 in the lengthwise direction to couple them together, and the axis of the shaft means 64 is positioned at an intersecting point of the center line 80*a* of the links 80 of the second link 62 in the lengthwise direction and the center line 104*a* of the links 104 of the third link 66 in the lengthwise direction to couple them together. A distance from the axis of the lateral shaft 90 to the axis of guide rollers 86, a distance from the axis of the lateral shaft 90 to the rotation axis at the lower end of the link 72, a distance from the axis of the lateral shaft 146 to the axis of guide rollers 120, and a distance from the axis of the lateral shaft 146 to the rotation axis at the upper end of the link 130, are specified to be substantially equal to one another.

Figure 17:
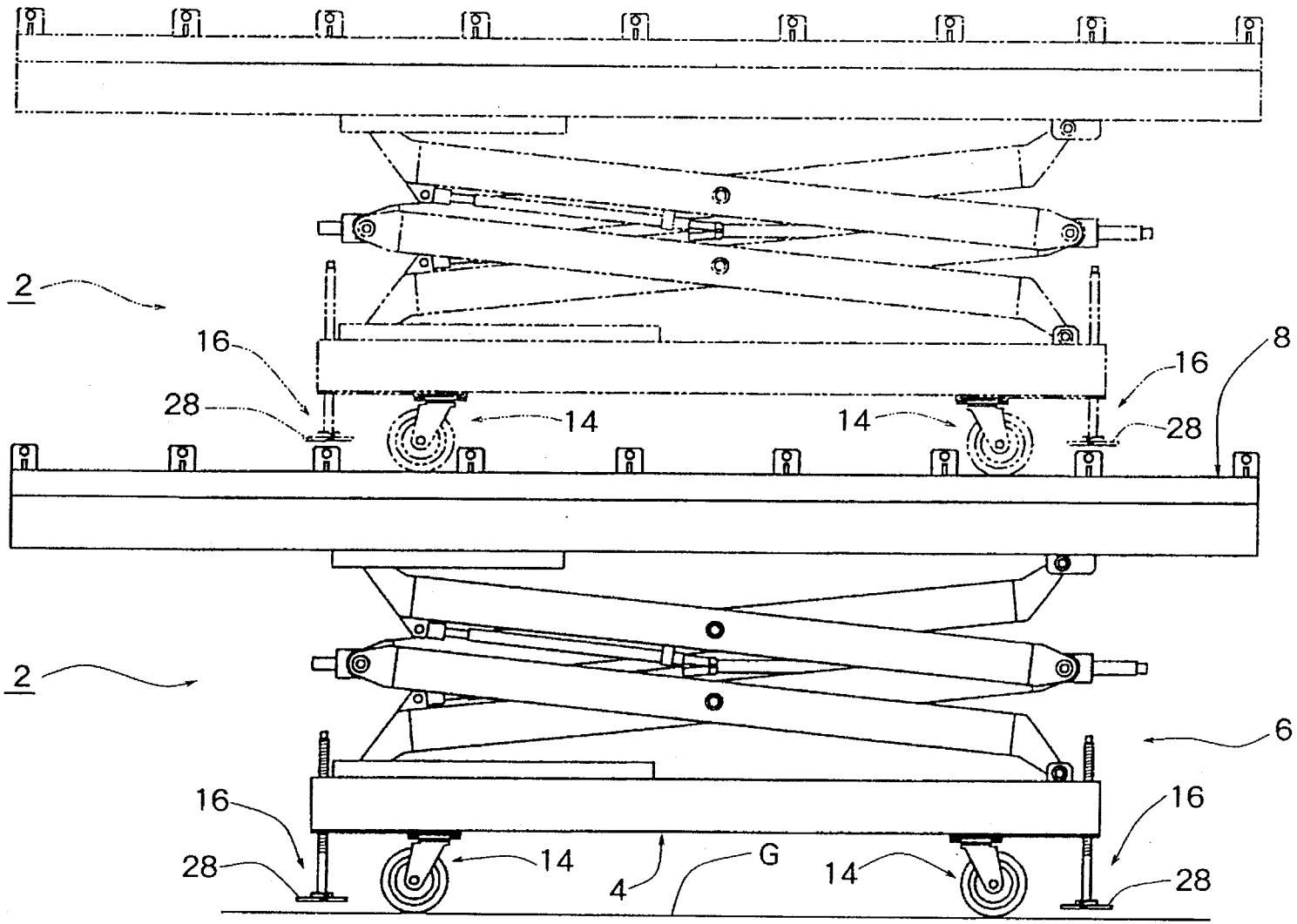
FIG. 17 is a front view illustrating a state in which the movable slab form unit constituted according to the present invention is in non-use.
Figure 18:
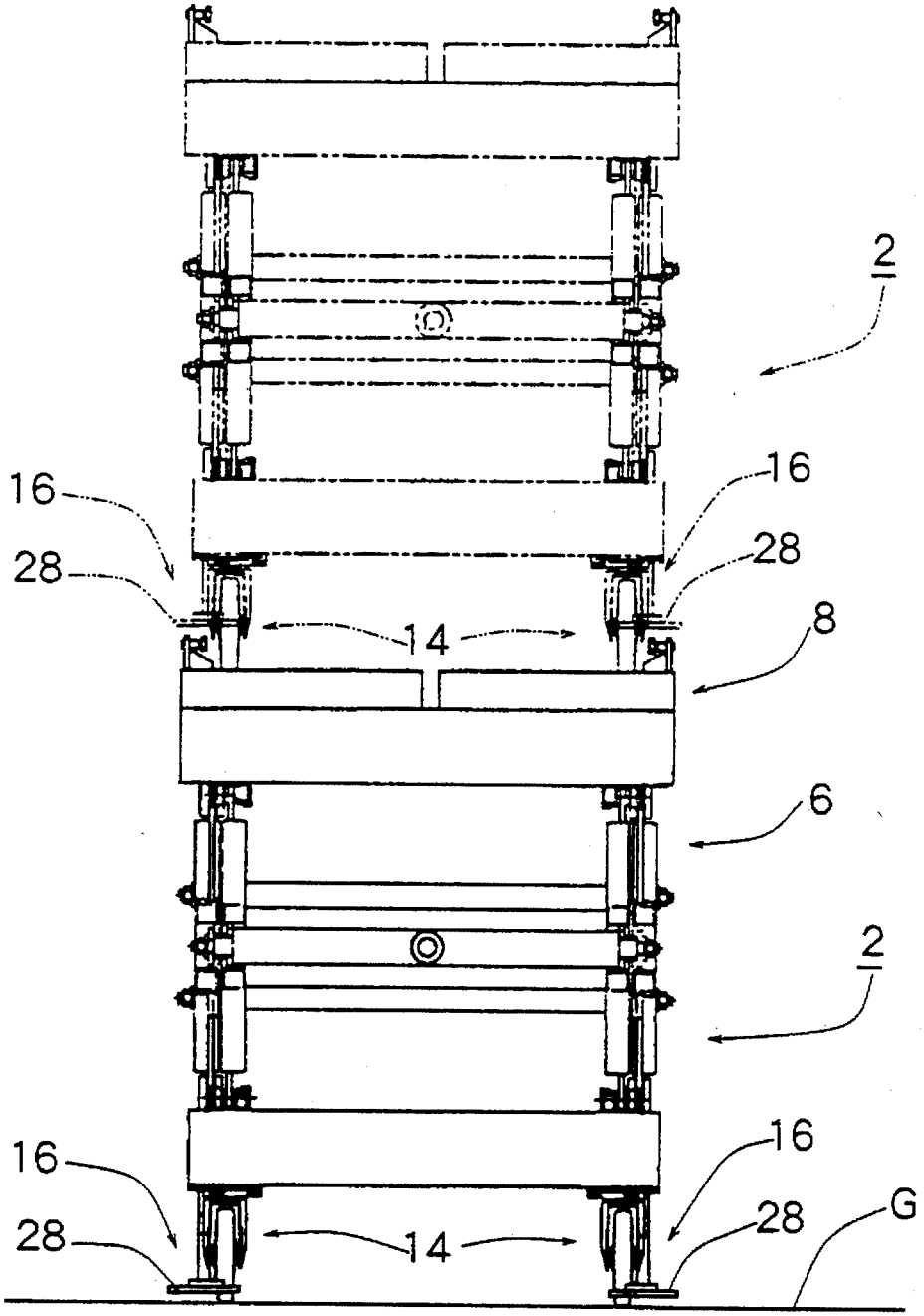
FIG. 18 is a side view of when

Referring to FIGS. 17 and 18, in a state where the movable slab form unit 2 is not in use, the base members 28 which are lower ends of the jacks 16 are adjusted to be at a position which is not in contact with the surface G on which they are placed (adjusted to float over the surface G on which they are placed). Accordingly, the base plate 4 is supported by the swivel castors 14 to move on the surface G on which it is placed. The elevation motion means 6 assumes a state in which it is descended on the base plate 4. Ground clearance of the slab form means 8 becomes a minimum, and the constitution as a whole becomes compact. In this state, the movable slab form unit 2 can be moved favorably and conveniently. The swivel castors 14 can be locked if they are equipped with a widely known locking mechanism (not shown), so that the movable slab form unit 2 in the above-mentioned state can be stably transported. When it is desired to transport or store the movable slab form unit 2 in a more stable state, the base members 28 of the jacks 16 should be brought into contact with the surface G on which it is placed in a manner that the swivel castors 14 are floated on the surface G. Due to the base members 28 of the jacks 16, the movable slab form unit 2 is supported on the surface G without being allowed to move. It is allowable to transport and store a plurality of movable slab form units 2 having substantially the same constitution in a stacked manner. In this case, the movable slab form unit 2 of the lower side is supported on the surface G on which it is placed by the base members 28 of the jacks 16 so will be not allowed to move, and another movable slab form unit 2 (see two-dot chain lines in FIGS. 17 and 18) is stacked by using the swivel castors 14 on the lower movable slab form unit 2. In this case, each swivel castor 14 must be equipped with a known locking mechanism. As described above, in the state of not being in use, there can be optionally selected depending upon the circumstances whether the movable slab form unit 2 is supported on the surface G on which it is placed by either the jacks 16 inhibiting the movement or the swivel castors 14 permitting the movement or even when supported by the swivel castors 14, the known locking mechanism is used to inhibit the movement.

Referring to FIGS. 1 to 3 and 19, in order to form a concrete slab 210 (see FIG. 19), the movable slab form units 2 are transported to a construction site in a non-use state as explained with reference to FIGS. 17 and 18, and are then moved to a predetermined place by using the swivel castors 14. The jacks 16 are operated to lower the base members 28 until they come into contact with the surface G on which they are placed. The base plate 4 is supported on the surface G on which it is placed by the base members 28 of jacks 16 in a manner of being inhibited from moving, and the upper surface of the base plate 4 is adjusted to become horizontal. The swivel castors 14 are floated over the surface G. Next, the elevation motion means 6 which is in a descended state is raised. That is, when the operation rod member 150 is turned in one direction by using the operation handle 158, the shaft means 68 in the elevation motion means 6 moves toward a direction (rightwards in FIGS. 1 and 19) to approach the shaft means 64 along the operation rod member 150. Accordingly, the guide rollers 86 of the second links 62 of the elevation motion means 6 moves in a direction (rightwards in FIGS. 1 and 19) to approach the lower end of the first link 60 along the corresponding guide rail members 46 of the base plate 4. At the same time, the guide rollers 120 of the third link 66 move in a direction (rightwards in FIGS. 1 and 19) to approach the upper end of the fourth link 70 along the corresponding guide rail members 172 of the center form 160. Thus, the elevation motion means 6 move to ascend and the slab form means 8 is raised to a predetermined height.

In the case where the elevation motion means 6 of the slab form unit 2 with the side forms 162 being folded on the center form 160 is moved to ascend, it is first raised up to a roughly estimated height and then, the side forms 162 are positioned so as to be nearly flush with the center form 160. Thereafter, the adjusting bolts 202 (see FIG. 14) are operated to adjust the upper surfaces. As required, furthermore, the jacks 16 are adjusted such that the upper surfaces of the slab form means 8 becomes horizontal. Then, the height is finely adjusted by using the operation handle 158. Alternatively, there can be contrived a method of raising the elevation motion means 6 after the side forms 162 have been in advance positioned to be flush with the center form 160. In raising the elevation motion means 6, the operation handle 158 may be replaced by an electrically powered drill 212 (see FIG. 19) to accomplish quick rising.

After the upper surface and height of the slab form means 8 have been adjusted, the turn buckle is removed from the clip 102 and its length is adjusted so as to be interposed between the links 80 of the second link 62 and the engaging portions 50 of the guide rail members 46 of the base plate 4. The spherical portion 100 of the turn buckle 92 is detachably engaged with the engaging portion 50 of the guide rail member 46. Accordingly, the guide rollers 86 of the second link 62 are prevented from moving in a direction (leftwards in FIGS. 1 and 19) to separate away from the lower ends of the first link 60 along the corresponding guide rail members 46. That is, by bringing the spherical portion 100 of the turn buckle 92 into engagement with the engaging portion 50 of the base plate 4, it is made possible to prevent the lower ends of the second link 62 of the elevation motion means 6 from moving along the guide rail members 46 of the base plate 4 in a direction in which the slab form means 8 descends. The turn buckle 122 is removed from the clip 124 and its length is adjusted so as to be interposed between the links 104 of the third link 66 and the engaging portion 50 of the corresponding guide rail member 172 of the center form 160. The spherical portion 100 of the turn buckle 122 is detachably engaged with the engaging portion 50 of the guide rail member 172. Accordingly, the guide rollers 120 of the third link 66 are prevented from moving along the corresponding guide rail member 172 in a direction (leftwards in FIGS. 1 and 19) to separate away from the upper ends of the fourth link 70. That is, by bringing the spherical portion 100 of the turn buckle 122 into engagement with the engaging portion 50 of the center form 160, it is made possible to prevent the upper ends of the third link 66 of the elevation motion means 6 from moving along the guide rail member 172 of the center form 160 in a direction in which the slab form means 8 descends.

The presence of the turn buckle 92 greatly helps prevent the displacement of the elevation motion means 6 and maintain a predetermined attitude of the elevation motion means 6 at the time of ascending state despite a change in the load exerted on the elevation motion means 6 via the slab form means 8 when concrete is poured. That is, the second link 62 which is coupled at its lower end to the base plate 4 to move along the base plate and is instable against a support of the load, is reliably prevented from moving owing to the turn buckle 92 which is the support rod means. Accordingly, the elevation motion means 6 is reliably prevented, i.e., the slab form means 8 is reliably prevented from being deviated by a change in the load, and a required high degree of precision is easily guaranteed for the form. Similarly, furthermore, presence of the turn buckle 122 greatly helps prevent the displacement of the elevation motion means 6 and maintain a predetermined attitude of the elevation motion means 6 at the time of ascending state despite a change in the load exerted on the elevation motion means 6 via the slab form means 8 when concrete is poured. That is, the third link 66 which is coupled at its upper end to the slab form means 8 to move along the slab form means and is instable against a support of the load, is reliably prevented from moving owing to the turn buckle 122 which is the support rod means. Accordingly, the elevation motion means 6 is reliably prevented, i.e., the slab form means 8 is reliably prevented from being deviated by a change in the load, and a required high degree of precision is easily guaranteed for the form.

As shown in FIG. 9, furthermore, the elevation motion means 6 is prevented from being deformed by the presence of two pieces of reinforcing plates 78 of substantially a right-angled triangular shape disposed at both ends of the lateral frame 74 formed of a pipe member of the first link 60, two pieces of reinforcing plates 88 having a similar constitution disposed at both ends of the lateral frame 82 of the second link 62, two pieces of reinforcing plates 116 having a similar construction disposed at both ends of the lateral frame 106 of the third link 66, and two pieces of reinforcing plates 144 having a similar constitution disposed at both ends of the lateral frame 132 of the fourth link 70. Accordingly, the elevation motion means 6 is stabilized more reliably.

Figure 19:
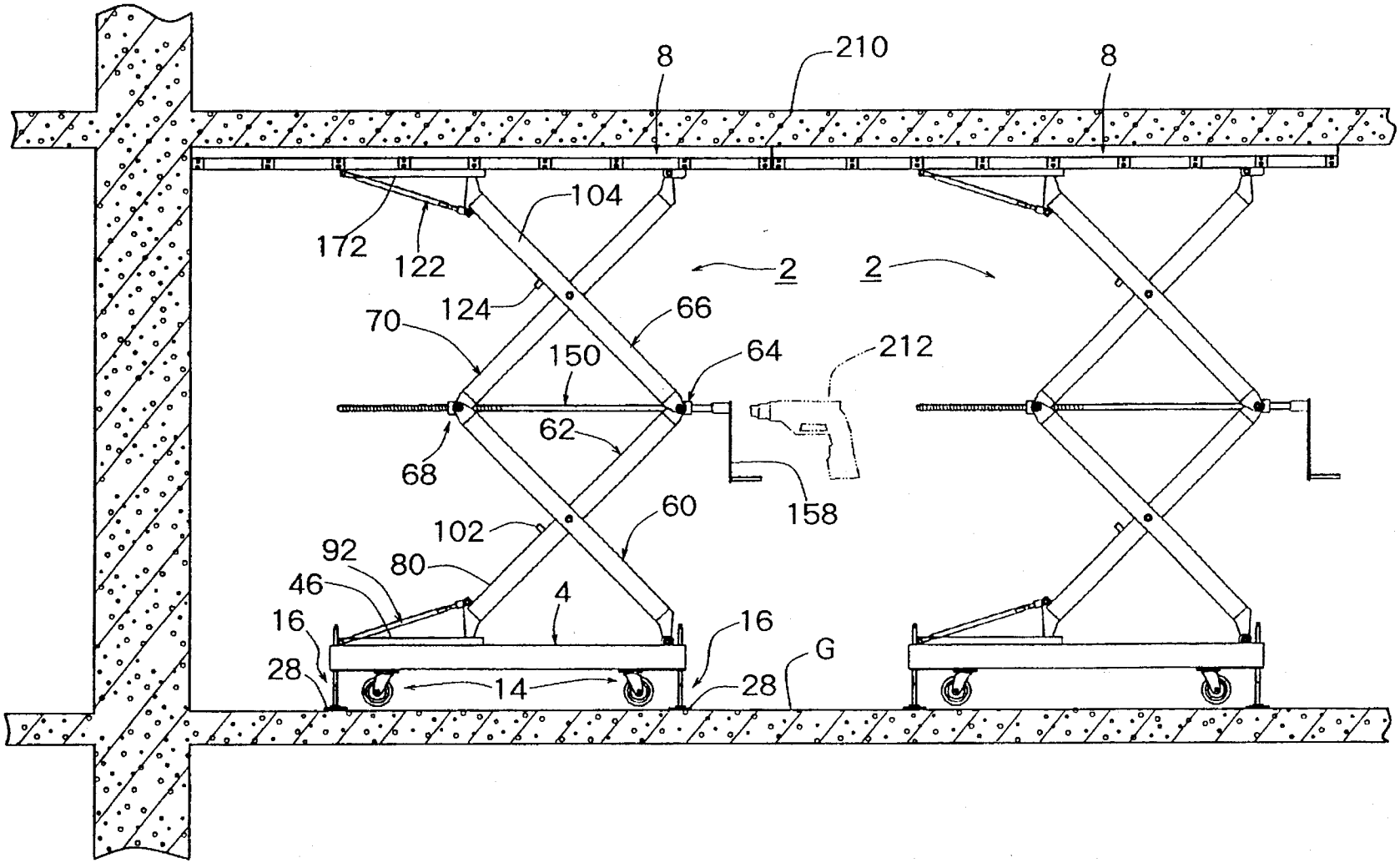
FIG. 19 is a front view schematically illustrating a state in which the movable slab form unit constituted according to the present invention is in use.

When the concrete slab 210 is to be practically formed, as shown in FIG. 19, the movable slab form units 2 having substantially the same constitution are provided in a predetermined number and are disposed at predetermined positions. The movable slab form units 2 are operated in the same manner as described above. Accordingly, the slab form means 8 are arranged in the transverse and longitudinal directions, while maintaining a predetermined height, without substantially forming any gap. With the whole slab form means 8 being positioned flush with one another, therefore, there are formed slab forms having a predetermined area. Then, concrete is poured into the slab forms to form the concrete slab 210.

When a predetermined period of time has passed after the concrete had been poured, the movable slab form units 2 are removed from the concrete slab 210 that has been formed. Described below first is how to remove a movable slab form unit 2. The lengths of the turn buckles 122 are shortened to release the engagement between the spherical portions 100 and the engaging portions 50 of the corresponding guide rail members 172. The turn buckles 122 are turned and are held by the corresponding links 104 of the third link 66 via clips 124. Similarly, the turn buckles 92 are shortened to release the engagement between the spherical portions 100 and the engaging portions 50 of the corresponding guide rail members 46. The turn buckles 92 are turned and are held by the corresponding links 80 of the second link 62 via clips 102. Then, the elevation motion means 6 that is in an ascended state is descended. That is, when the operation rod member 150 is rotated in the other direction using the operation handle 158, the shaft means 68 of the elevation motion means 6 moves along the operation rod member 150 in a direction (leftwards in FIGS. 1 and 19) to separate away from the shaft means 64. As a result, the guide rollers 86 of the second link 62 of the elevation motion means 6 move along the corresponding guide rail members 46 of the base plate 4 in a direction (leftwards in FIGS. 1 and 19) to separate away from the lower ends of the first link 60. At the same time, the guide rollers 120 of the third link 66 move along the corresponding guide rail members 172 of the center form 160 in a direction (leftwards in FIGS. 1 and 19) to separate away from the upper ends of the fourth link 70. Accordingly, the elevation motion means 6 descends, and the upper surface of the slab form means 8 separates away from the lower surface of the concrete slab 210 and is lowered down to a predetermined position.

The jacks 16 are operated so that the base members 28 are raised to a position at which they are not in contact with the surface G on which they are placed. The base plate 4 is supported by the swivel castors 14 to move around on the surface G on which it is placed. That is, the movable slab form unit 2 is placed in a state where it is not in use (see FIGS. 17 and 18). It is also possible to operate the jacks 16 so that the upper surface of the slab form means 8 is separated away from the lower surface of the concrete slab 210 prior to operating the operation handle 158, in order to release the load that is acting on the whole slab form means 8. The same operation is effected for each of the movable slab form units 2. If a reduction mechanism such as reduction gears is provided between the operation handle 158 and the operation rod member 150, the operation rod member 150 can be turned with a decreased force using the operation handle 158.

Described below with reference to FIGS. 20 to 28 is another embodiment of the movable slab form unit constituted according to the present invention. The movable slab form unit which is generally designated at 300 is substantially different from the above-mentioned movable slab form unit 2 with respect to use of hydraulic pressure for the elevation motion mechanism 10 for raising and lowering the elevation motion means 6, and with respect to the constitution of the slab form means 8. With respect to other points, the movable slab form unit 300 has substantially the same constitution as the above-mentioned movable slab form unit 2. In FIGS. 20 to 28, therefore, the portions which are substantially the same as those of FIGS. 1 to 19 are denoted by the same reference numerals and their description is not repeated. Here, the movable slab form unit 300 is provided with neither the threaded operation rod member 150 nor the operation means 152 that are provided for the movable slab form unit 2. Accordingly, bosses 112 and 138 are not formed in the shaft means 64 and 68. Furthermore, support rod means 92 and 122 are omitted in FIGS. 20 and 21.

In FIGS. 20 to 23, the elevation motion mechanism 10 includes a hydraulic cylinder 302 disposed between the base plate 4 and the elevation motion means 6, and a hydraulic pump 304 for moving the hydraulic cylinder 302 up and down. More concretely, the elevation motion mechanism 10 is equipped with the hydraulic cylinder 302 interposed between the lateral frame 74 of the first link 60 and the intermediate frame 26 of the base plate 4, and the hand-operated hydraulic pump 304 provided on the base plate 4 to extend or contract the hydraulic cylinder 302. Support brackets 306 and 308 are provided at intermediate portions of the lateral frame 74 and intermediate frame 26 in the lengthwise direction. The hydraulic cylinder 302 has a cylinder 310 and a piston rod 312, and an end of the cylinder 310 is pivotably coupled to the support bracket 308 and an end of the piston rod 312 is pivotably coupled to the support bracket 306. The hand-operated hydraulic pump 304 is equipped with an operation lever 314 and a release lever 316.

Figure 24:
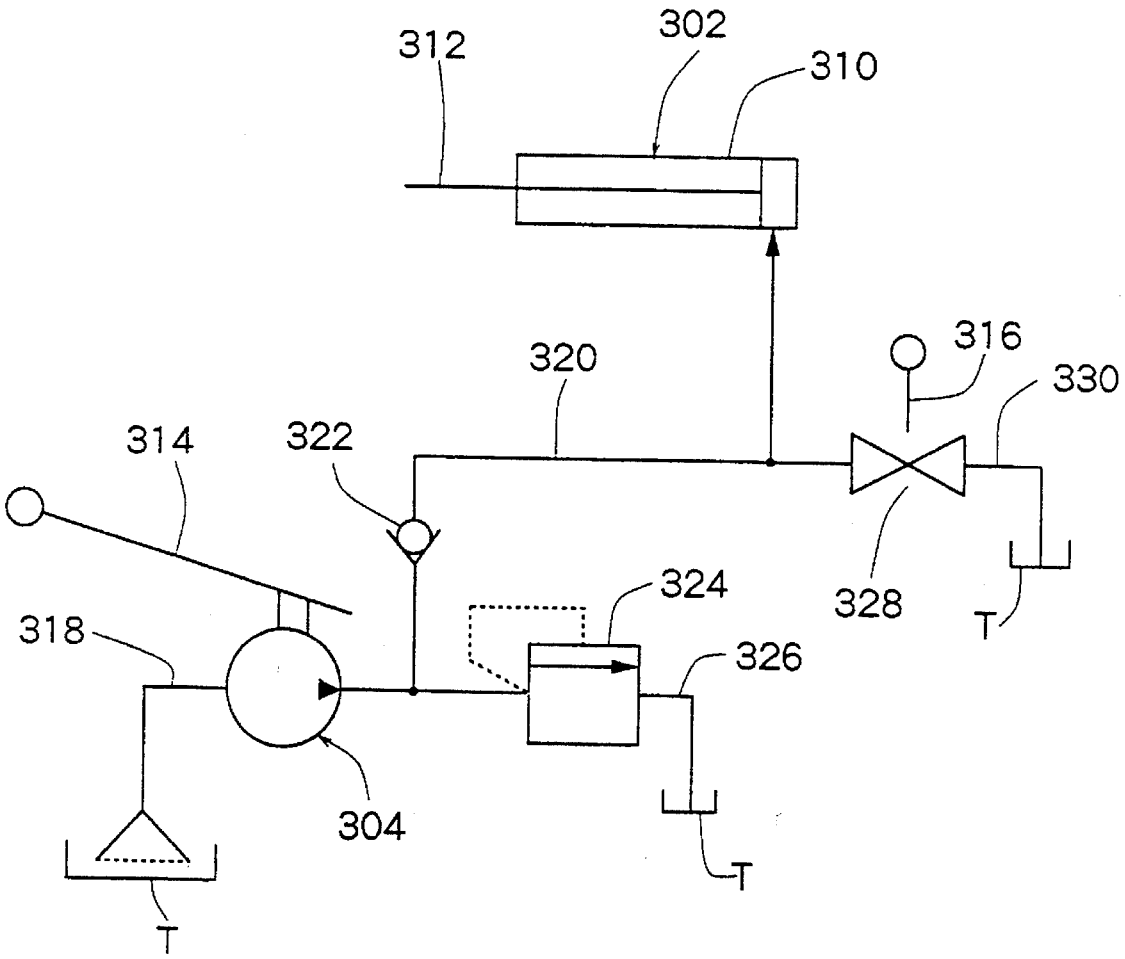
FIG. 24 is a diagram of a hydraulic circuit included in an elevation motion mechanism of the movable slab form unit shown in FIGS. 20 to 23.

FIG. 24 is a diagram of a hydraulic circuit included in the elevation motion mechanism 10, wherein the intake side of the hand-operated hydraulic pump 304 and a fluid tank T are connected together via a fluid passage 318. The flow-out side of the hand-operated hydraulic pump 304 and the piston head side of the hydraulic cylinder 302 are connected together via a fluid passage 320. A check valve 322 is disposed in the fluid passage 320. The fluid passage 320 on the upstream side of the check valve 322 is connected to a fluid tank T via a fluid passage 326 in which a relief valve 324 is disposed, and the fluid passage 320 on the downstream side of the check valve 322 is connected to a fluid tank T via a fluid passage 330 in which a release valve 328 is disposed. The hand-operated hydraulic pump 304 is equipped with the operation lever 314, and the release valve 328 is provided with the release lever 316. The release valve 328 opens the fluid passage 330 at an open position of the release lever 316, and closes the fluid passage 330 at a closed position of the release lever 316. The hand-operated hydraulic pump 304 incorporates, as an assembly, the hydraulic circuit except part (concretely, pressure-resistant hose) of the fluid passage 320 and the hydraulic cylinder 302.

The thus constituted elevation motion mechanism 10 operates as described below. To raise the elevation motion means 6, the release lever 316 is brought to the closed position to close the fluid passage 330. Then, the operation lever 314 of the hand-operated hydraulic pump 304 is operated, so that the pressurized fluid is fed to the piston head side of the hydraulic cylinder 310 via the fluid passage 320, whereby the piston rod 312 extends and the elevation motion means 6 is raised. Accordingly, the slab form means 8 is raised to a predetermined height corresponding thereto. To lower the elevation motion means 6, on the other hand, the release lever 316 is brought to the open position to open the fluid passage 330. The pressurized fluid that had been fed to the piston head side of the hydraulic cylinder 310 is returned back to the fluid tank T via the fluid passage 330. The piston rod 312 contracts, and the elevation motion means 6 descends. As a result, the slab form means 8 descends to a predetermined height corresponding thereto. In the step of lowering the elevation motion means 6, when the release lever 316 is brought to the closed position, the fluid passage 330 is closed and the slab form means 8 is held at any desired height. These operations are carried out by the operator by simply manipulating the operation lever 314 and the release lever 316. Thus, the slab form means 8 can be ascended and descended smoothly.

Figure 20:
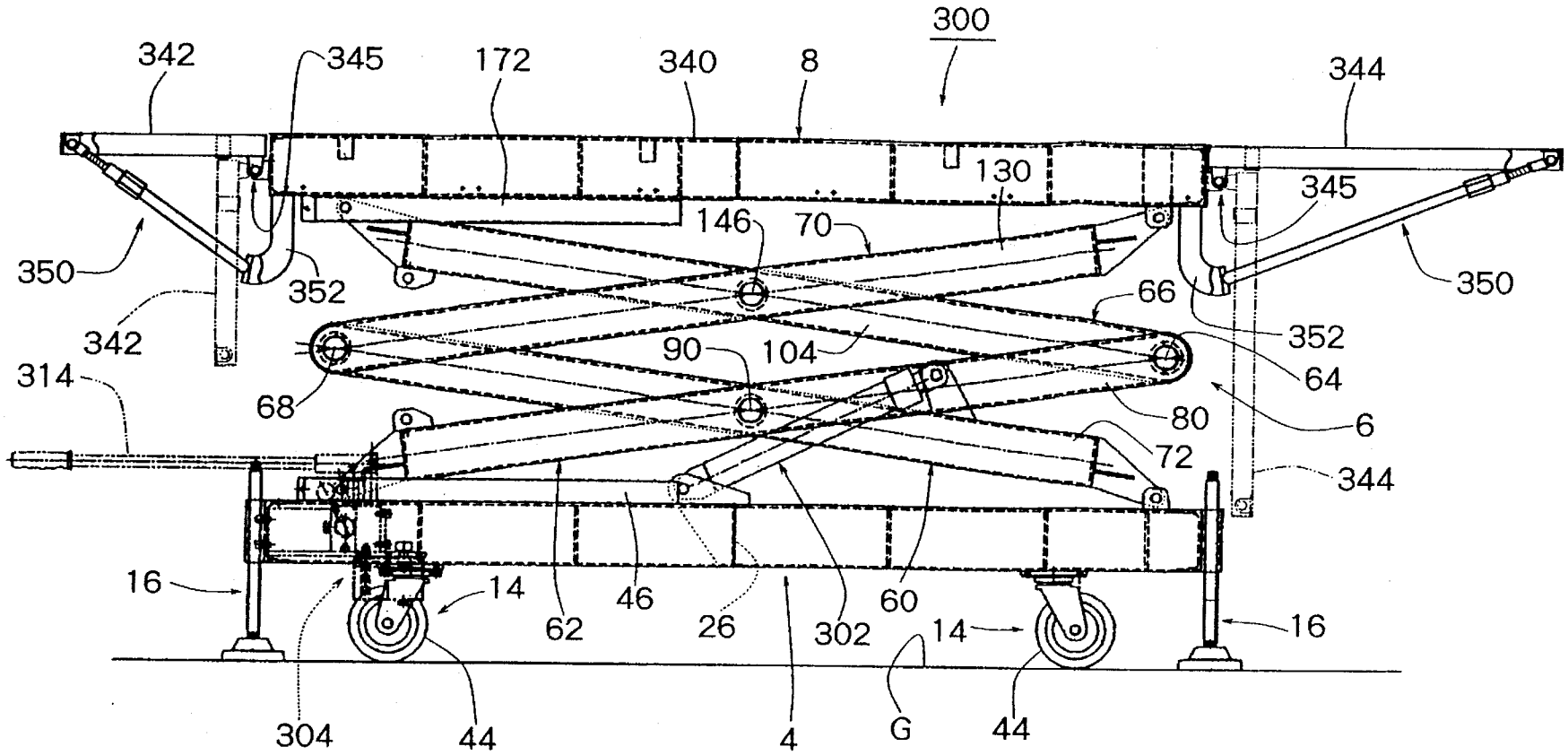
FIG. 20 is a front view illustrating another embodiment of the movable slab form unit constituted according to the present invention.
Figure 21:
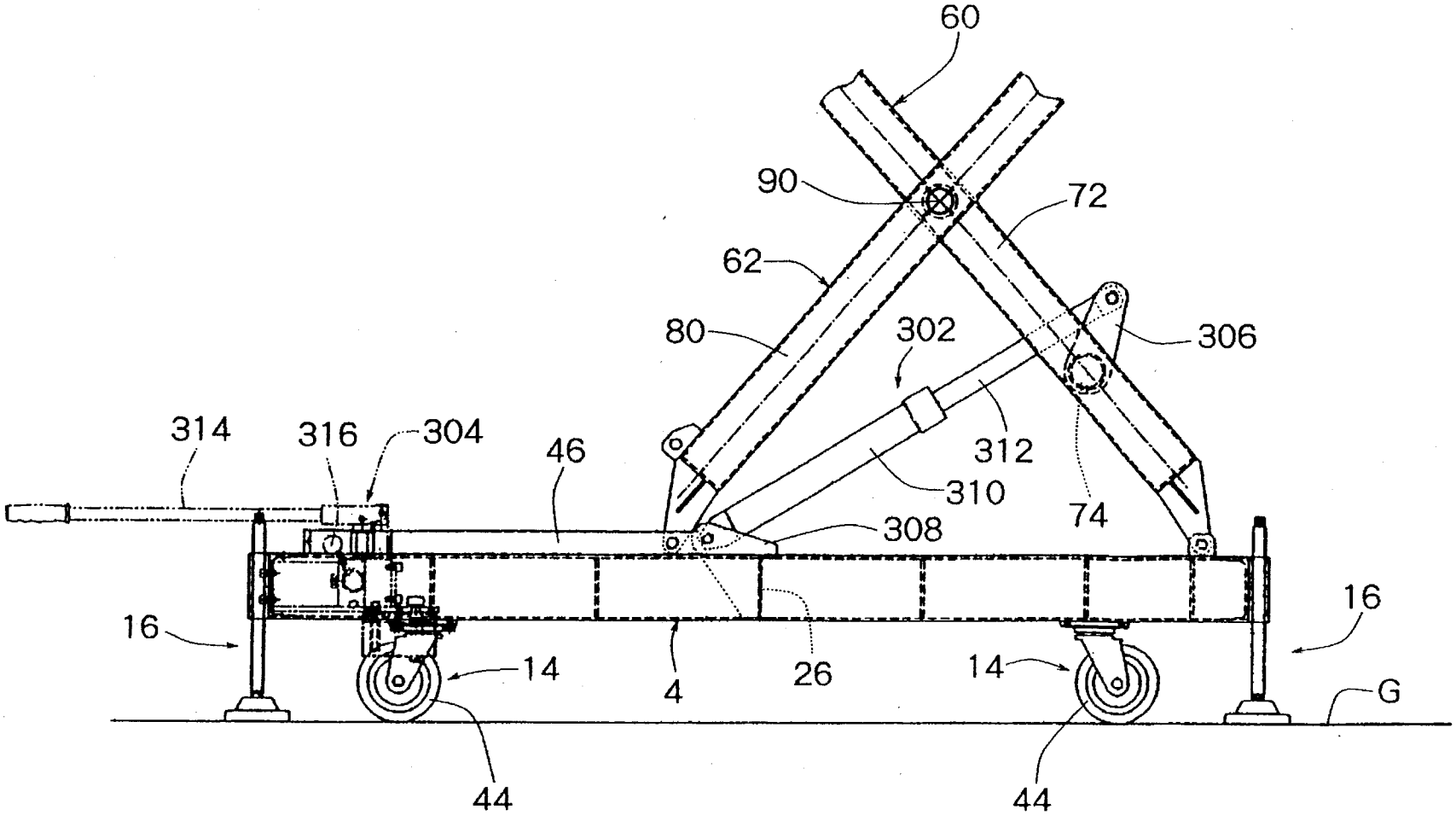
FIG. 21 is a front view illustrating a state in which the elevation motion means of the movable slab form unit shown in FIG. 20 is raised, and illustrates a lower portion thereof.
Figure 22:
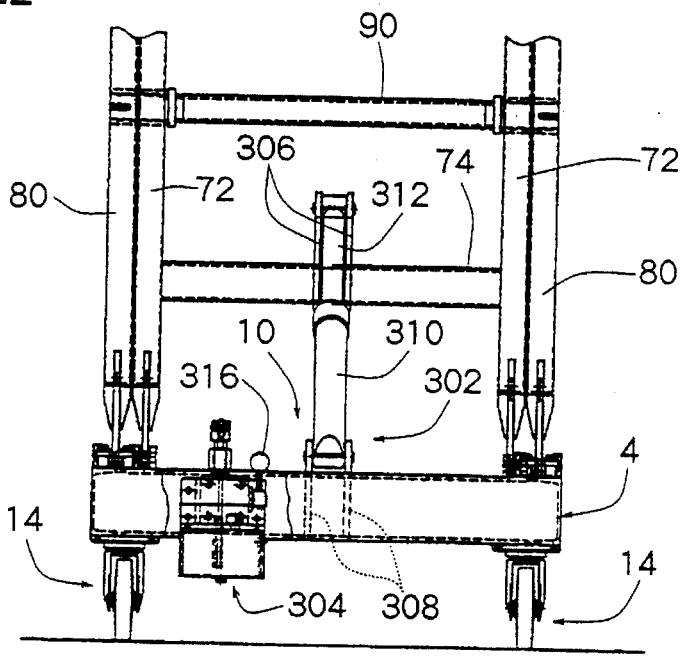
FIG. 22 is a side view of when
Figure 23:
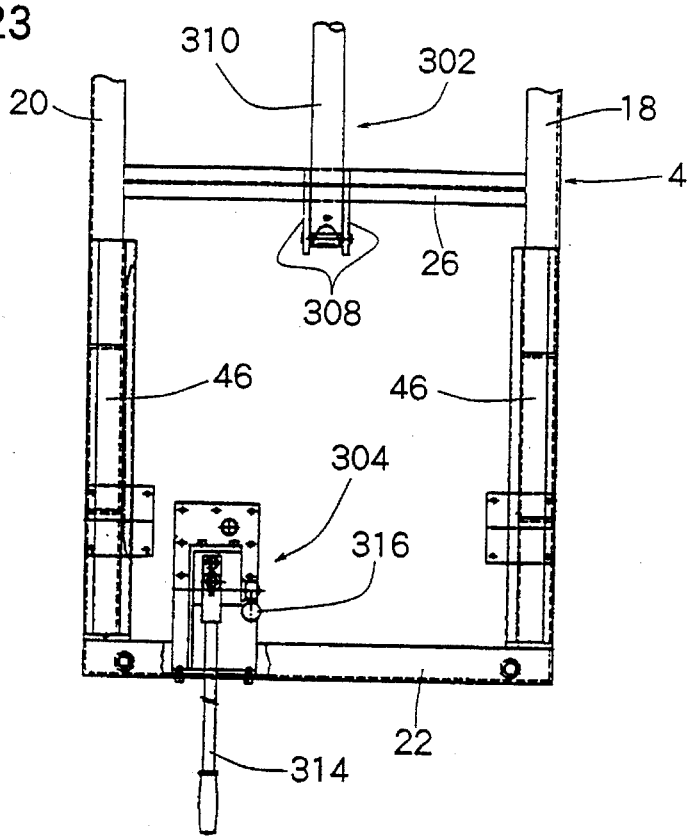
FIG. 23 is an upper plan of FIG. 22 and shows a portion of the elevation means in a simplified manner.
Figure 25:
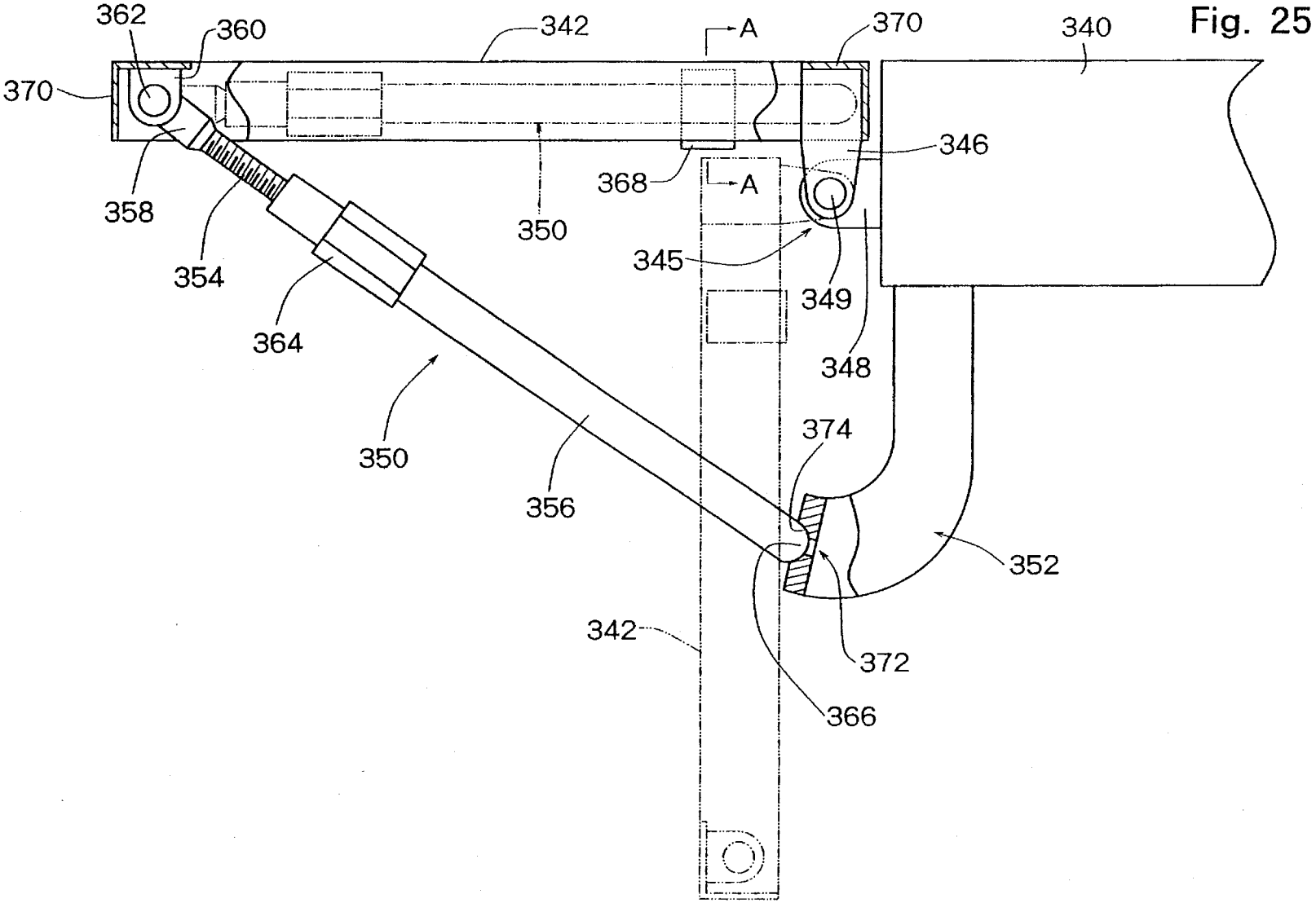
FIG. 25 is an enlarged view of part of FIG. 20 in a cut-away manner.
Figure 26:
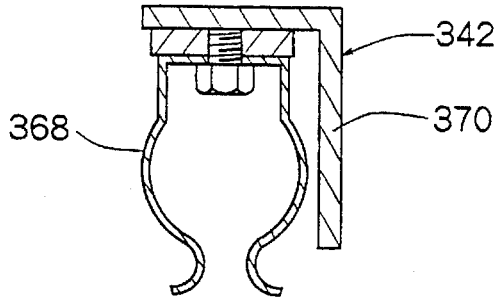
FIG. 26 is a sectional view along the arrow A—A of FIG. 25.

Next, described below with reference to FIGS. 20, 25 and 26 is the constitution of the slab form means 8. The slab form means 8 includes a main frame body 340 having a substantially rectangular shape and a substantially flat upper surface, and auxiliary frame bodies 342 and 344 which are disposed neighboring both sides of the main frame body 340 and having a substantially rectangular shape and substantially flat upper surfaces. Though not illustrated, the main frame body 340 is surrounded by channel-like frames, and on the portions surrounded by the frames are disposed reinforcing frames having an L-shaped, an I-shaped or a plate-like cross section extending in the longitudinal and transverse directions. Though not illustrated, the auxiliary frame bodies 342 and 344 are surrounded by L-shaped frames, and on the portions surrounded by the frames are disposed reinforcing frames having an L-shaped or a plate-like cross section extending in the longitudinal and transverse directions. As will be obvious from FIG. 20, the auxiliary frame body 342 of the left side has a width smaller than that of the auxiliary frame body 344 of the right side. One side portion (right side portion in FIGS. 20 and 25) of the auxiliary frame body 342 is pivotably coupled to the left side portion of the main frame body 340 via hinge means 345, so that it can be selectively brought into a use state (position indicated by solid lines in FIGS. 20 and 25) where the upper surface thereof is positioned to be substantially flush with the upper surface of the main frame body 340 and into a non-use state (position indicated by two-dot chain lines in FIGS. 20 and 25) where it hangs down from the one side portion (left side portion) of the main frame body 340. A downwardly extending plate 346 is provided at the right side portion of the auxiliary frame body 342, and a pair of support plates 348 are provided at a distance at a left side portion of the main frame body 340, corresponding to the support plate 346. The plate 346 is disposed between the pair of support plates 348 and is pivotably supported by a pin 349, so that the auxiliary frame body 342 is pivotably supported by the main frame body 340. The plate 346, pair of support plates 348 and pin 349 constitute a hinge means 345. Such a hinge means 345 is provided at plural places.

Support rod means 350 of which the length can be adjusted are pivotably attached at their ends on one side to both end portions (in a direction perpendicular to the surface of the paper of FIGS. 20 and 25) on the other side (left side) of the auxiliary frame body 342, and downwardly extending support members 352 are provided at both end positions on the left side of the main frame body 340, corresponding to the support rod means 350. The support rod means 350 have substantially the same constitution and only one of them will be described. The support rod means 350 includes an externally threaded rod member 354 and an internally threaded rod member 356 engaged with the externally threaded rod member 354. A plate portion 358 is formed at an end of the externally threaded rod member 354, and a pair of support plates 360 are provided at a distance at the left side portion of the auxiliary frame body 342. The plate portion 358 is disposed between the pair of support plates 360 and is pivotably supported by a pin 362, whereby the externally threaded rod member 354 is pivotably supported at the left side portion of the auxiliary frame body 342. An external thread is formed on the other end side of the externally threaded rod member 354. An internal thread that is not shown is formed on one end side of the internally threaded rod member 356. The internal thread is formed by only a predetermined length from one end of the internally threaded rod member 356 toward the other end. A hexagonal portion 364 is formed on the outer peripheral portion of the internally threaded rod member 356 to facilitate the turning operation. A spherical portion 366 is formed at the other end of the internally threaded rod member 356. By bringing the internally threaded portion of the internally threaded rod member 356 into engagement with the external thread of the externally threaded rod member 354, the internally threaded rod member 356 and the externally threaded rod member ... with the freedom of adjusting the turned to increase its length in the axial direction. By bringing the spherical portion 366 of the internally threaded rod member 356 into engagement with the recessed portion 374 of the engaging portion 372, the auxiliary frame body 342 is supported by the support member 352 via the support rod means 350. When the internally threaded rod member 356 is turned in this state, the length is further increased in the axial direction, whereby the auxiliary frame body 342 is turned on the pin 349 in the clockwise direction and is placed in the use state. Since the recessed portion 374 of the engaging portion 372 which will engage with the spherical portion 366 of the internally threaded rod member 356 has a spherical shape, the internally threaded rod member 356 can be turned relatively easily even in a state where the load of the auxiliary frame body 342 is exerted. In a state of supporting the load of the auxiliary frame body 342, therefore, the adjusting operation is easily carried out to bring the upper surface of the auxiliary frame body 342 to be flush with the upper surface of the main frame body 340. To put the auxiliary frame body 342 into the non-use state from the use state, the internally threaded rod member 356 is, first, turned in the reverse direction. Since the support rod means 350 is shortened in the axial direction, the auxiliary frame body 342 turns on the pin 349 in the counterclockwise direction, and the left end portion is lowered to some extent. If the auxiliary frame body 342 is lifted up in this state, the spherical portion 366 of the internally threaded rod member 356 can be easily removed from the recessed portion 374 of the engaging portion 372. The support rod means 350 is further shortened in the axial direction and is held by the clip 368. The auxiliary frame body 342 can be turned on the pin 349 in the counterclockwise direction by utilizing its own weight. Though the support rod means 350 are usually provided at both ends of the auxiliary frame body 342, they can be provided at many more portions as required.

Figure 27:
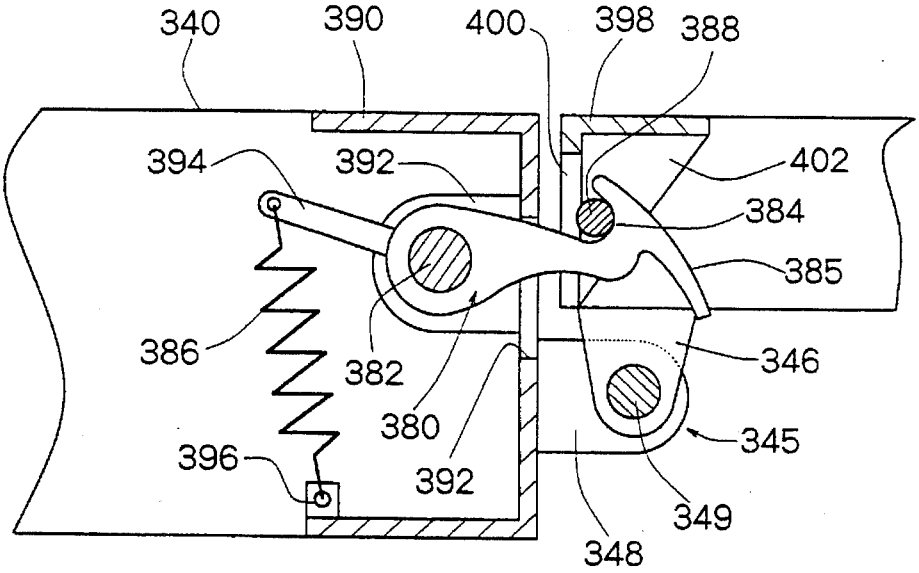
FIG. 27 is a view illustrating part of the slab form means included in FIG. 20 in a cut-away manner.
Figure 28:
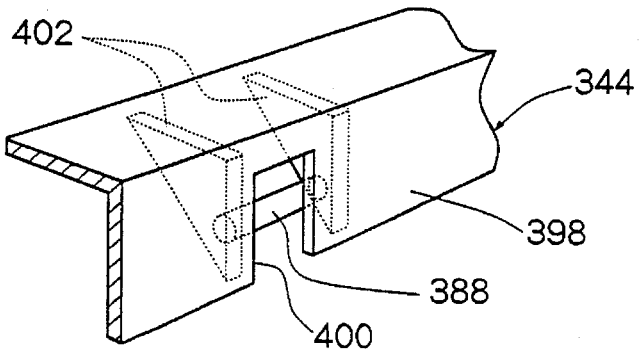
FIG. 28 is a perspective view illustrating part of a side frame body of FIG. 27 in a cut-away manner.

The support rod means 92 and 122 shown in FIG. 1 are ... actively, but, instead, may 386 is disposed between the hook member 380 and the main frame body 340 to urge the hook portion 384 toward the engaging direction (counterclockwise direction in FIG. 27). An engaging pin 388 is provided at a position corresponding to the hook portion 384 on the left side portion of the auxiliary frame body 344. A positional relationship between the engaging pin 388 and the hook member 384 is so defined that the engaging pin 388 is brought into engagement with the hook portion 384 when the auxiliary frame body 344 is turned on the hinge means 345 up to the use state or near to the use state. The engagement between the hook portion 384 and the engaging pin 388 is released when the hook member 380 is turned on the support pin 382 in the clockwise direction in FIG. 27 against the resilient force of the spring member 386.

More concretely, the main frame body 340 includes a channel-like frame 390 that defines the right side portion thereof. A rectangular hole 392 is formed in the frame 390, and the right end portion of the hook member 380 outwardly protrudes through the hole 392. The left end portion of the hook member 380 located on the inside (left side in FIG. 27) of the hole 392 is pivotably supported by the frame 390 via a support pin 382. That is, on the frame 390 are provided a pair of support plates 392 at a distance, and between the support plates 392 is provided a support pin 382 without being allowed to rotate. The left end portion of the hook member 380 is pivotably supported by the support pin 382. The hook portion 384 is formed at the right end of the hook member 380 located on the outside (right side in FIG. 27) of the hole 392. A curved guide portion 385 is formed on the back of the hook portion 384. An arm 394 is provided at the left end of the hook member 380, and an engaging portion 396 is provided on the bottom of the frame 390. A spring member 386 is disposed between the arm 394 and the engaging portion 396 to urge to turn the hook member 380 on the support pin 382 in a direction (counterclockwise direction in FIG. 27) to come into contact with the upper end of the hole 392.

The auxiliary frame body 344 includes a frame 398 of an L-shape in cross section that defines the left side portion thereof. The frame 398 has a rectangular notch 400 formed at a position corresponding to the hook portion 384 and heading upwardly from the lower end. On the inside of the notch 400 (right side in FIG. 27) is provided an engaging pin 388 running across the notch 400. That is, triangular support plates 402 are provided on both sides of the notch 400 on the inside of the frame 398, and the engaging pin 388 is secured between the support plates 402. While the auxiliary frame body 344 turns on the hinge means 345 from the non-use state (indicated by two-dot chain lines in FIG. 20) to the use state (indicated by solid lines in FIG. 20), the engaging pin 388 of the auxiliary frame body 344 comes into contact with the guide portion 385 formed on the back of the hook portion 384 and works to turn the hook portion 384 in the clockwise direction in FIG. 27 in which it is lowered against the resilient force of the spring member 386. As the auxiliary frame body 344 is further turned to reach the use state or nearly the use state, the engaging pin 388 is removed from the guide portion 385. The hook member 380 is turned by the resilient force of the spring member 386 on the support pin 382 in the counterclockwise direction and, hence, the hook portion 384 comes into engagement with the engaging pin 388. As a result, the auxiliary frame body 344 is prevented from turning about the hinge means 345 in the clockwise direction in FIG. 27. When the hook member 380 is turned on the support pin 382 in the clockwise direction in FIG. 27 against the resilient force of the spring member 386, the hook portion 384 is disengaged from the engaging pin 388. In putting the auxiliary frame body 344 into the use state, therefore, the engaging pin 388 of the auxiliary frame body 344 can be anchored to the hook portion 384 of the main frame 340. In this state, the auxiliary frame body 344 needs not be supported by hand, and the auxiliary frame body 344 is held in a state close to the use state with respect to the main frame body 340. Thereafter, though not limited thereto only, the operation can be very easily carried out to put the auxiliary frame body 344 into the use state with respect to the main frame body 340 by utilizing, for example, the above-mentioned support rod means 350. According to the present invention, the labor can be greatly reduced when the auxiliary frame body 344 is heavy, and enhance the operation efficiency to a striking degree.

Though the present invention was described above in detail by way of embodiments, it should be noted that the invention can be varied or modified in a variety of other ways without departing from the scope of the invention. For instance, the slab form means 8 in the movable slab form unit 300 may be constituted by the main frame body 340 only. In this case, the area of the main frame body 340 must be increased nearly to such an extent that it includes the auxiliary frame bodies 342 and 344, leaving a problem in regard to space at the time of transport and preservation. Therefore, provision of the foldable auxiliary frames 342 and 344 as in the above-mentioned embodiments, is advantageous. The area of the slab form means 8 can be further increased by providing the auxiliary frame bodies along the four sides of the main frame body 340. Even when the slab form means 8 is constituted by the main frame body 340 only or by the combination of the main frame body 340 and auxiliary frame bodies, what is important is that the upper surfaces are flat and are substantially flush with one another. Owing to this constitution, a flat slab form is easily formed by simply laying a panel on the upper surface of the slab form means 8.

The elevation motion means 6 provided for the movable slab form units 2 and 300 shown in FIGS. 1 and 20 includes the first link 60, second link 62, third link 66 and fourth link 70. When a combination of two links (e.g., a combination of the first link 60 and the second link 62) coupled in an X-shape is regarded to be a one-stage type, the elevation motion means 6 described in the above embodiments is of the two-stage type. The number of stages of the elevation motion means 6 can be freely selected such as one-stage type, thee-stage type, four-stage type, - - - , in addition to the two-stage type. In the case of the one-stage type, the upper ends of the first link 60 are coupled to the slab form means 8 to move along the slab form means, and the upper ends of the second link 62 are pivotably coupled to the slab form means 8. In the case of the three-stage type, a combination of two links that are not shown are disposed and coupled between the first stage (combination of the first link 60 and the second link 62) and the second stage (combination of the third link 66 and the fourth link 70). In the case of the four-stage type, combinations each consisting of two links that are not shown are disposed and coupled between the first stage and the second stage. As described above, the number of stages of the elevation motion means 6 can be suitably selected from the one-stage type through up to a plurality-stage type.

Though the present invention is concerned with a movable slab form unit, it can be also used as an operation plate that can be raised and lowered, as a device for raising and lowering heavy articles, or as a load plate that can be raised and lowered.

According to the movable slab form unit of the present invention described above by way of embodiments, the operation efficiency is markedly improved, required precision is easily accomplished, and cost of construction can be saved. Principal effects obtained by the present invention are described below in further detail.

(1) The slab form itself is formed as a unit and a slab form can be easily formed by providing the slab form units in a required number. Unlike the prior art, therefore, there is no need of providing many kinds of members to assemble and disassemble them for every construction work. Accordingly, the working efficiency is markedly improved, working time is greatly reduced, period of construction is shortened substantially, and manpower and cost of construction are decreased substantially, too.

(2) Precision needed for the slab form is achieved without requiring a high degree of skill, and the slab form is formed very easily while maintaining a sufficient degree of precision. Accordingly, specially trained men are not required, and the labor cost can be greatly decreased.

(3) The support rod means provided as a stabilizer means for raising the elevation motion means is very helpful for preventing the displacement of the elevation motion means and for maintaining a predetermined attitude thereof despite a change in the load exerted on the elevation motion means via the slab form means when concrete is poured. Accordingly, deviation of the elevation motion means, i.e., deviation of the slab form means is reliably prevented despite a change in the load, and a high precision required for the form is easily maintained.

(4) When the slab form means includes a main frame body and auxiliary frame bodies that are pivotably supported by the main frame body and when the auxiliary frame bodies are supported by support rod means of which the length can be freely adjusted to define its use state, the auxiliary frame bodies are easily held in the use state by the support rod means and the load exerted on the auxiliary frame bodies is firmly supported by the support rod means. Moreover, since the support rod means can be freely adjusted for its length, the upper surfaces of the auxiliary frame bodies can be very easily positioned to be flush with the upper surface of the main frame body by adjusting the length of the support rod means. This helps improve the precision of the upper surface of the slab form means and markedly improves the operation efficiency.

What we claim is:

1. A movable slab form unit that comprises a base plate which is movable along a surface on which it is placed, a slab form means, and an elevation motion means for connecting said slab form means to said base plate while maintaining a freedom of being raised and lowered;

wherein said slab form means includes a main frame body which has a substantially rectangular shape and a substantially flat upper surface, and auxiliary frame bodies which are disposed by side portions of said main frame body neighboring thereto and which have a substantially rectangular shape and a substantially flat upper surface;

wherein first side portions of said auxiliary frame bodies are pivotably coupled to the side portions of said main frame body via hinge means, so that said auxiliary frame bodies are selectively brought to a use state in which the upper surfaces thereof are positioned to be substantially flush with the upper surface of said main frame body and to a non-use state in which the upper surfaces thereof hang down from the side portions of said main frame body; and wherein first ends of support rod means of which the length is adjustable are pivotably supported at both ends on second side portions of said auxiliary frame bodies opposite said first side portions, and downwardly extending support members are provided at both ends on said side portions of said main frame body, corresponding to the support rod means, and engaging portions are provided at lower end portions of said support members so as to come into detachable engagement with second ends of said rod support means, and a state where said auxiliary frame bodies are in use is defined by an engagement of the second ends of said support rod means with the engaging portions of the corresponding support members.

2. A movable slab form unit according to claim 1, wherein each of said support rod means includes an externally threaded rod member and an internally threaded rod member engaged with said externally threaded rod member, a first end of said externally threaded rod member or said internally threaded rod member defines said first end of said support rod means, and a second end of said externally threaded rod member or said internally threaded rod member defines said second end of said support rod means, and a spherical portion is formed at the second end of said externally threaded rod member or said internally threaded rod member, and said engaging portion of said support member has a recessed portion of a spherical shape which is engageable with said spherical portion at the second end of said externally threaded rod member or said internally threaded rod member.

3. A movable slab form unit according to claim 1, wherein a hook member is pivotably provided at one of said side portions of said main frame body, said hook member being pivotably supported at its one end via a support pin supported by said main frame body, and said hook member having a hook portion at its other end in a manner that said hook portion protrudes beyond said one of said side portions of said main frame body, and a spring member is disposed between said hook member and said main frame body to turn said hook member in a direction in which said hook portion comes into engagement with an engaging pin that is provided on the first side portion of a corresponding one of said auxiliary frame bodies at a position corresponding to said hook portion, and wherein, when the corresponding one of said auxiliary frame bodies is turned on said hinge means to said use state or near to said use state, a positional relationship between said engaging pin and said hook member is so defined that said engaging pin comes into engagement with said hook portion, and, when said hook member is turned on said support pin against the resilient force of said spring member, said hook portion is disengaged from said engaging pin.

* * * * *